US009414734B2

(12) United States Patent
Moon et al.

(10) Patent No.: US 9,414,734 B2
(45) Date of Patent: Aug. 16, 2016

(54) SIDE BRUSH ASSEMBLY, ROBOT CLEANER AND CONTROL METHOD OF ROBOT CLEANER

(71) Applicant: Samsung Electronics Co., Ltd., Suwon-si (KR)

(72) Inventors: Joo Sung Moon, Gwangju (KR); Kyung Hwan Yoo, Incheon (KR); Kyoung Woun Kim, Gwangju (KR); Jeong Gon Song, Gwangju (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 452 days.

(21) Appl. No.: 14/014,902

(22) Filed: Aug. 30, 2013

(65) Prior Publication Data

US 2014/0067116 A1 Mar. 6, 2014

(30) Foreign Application Priority Data

Aug. 30, 2012 (KR) ..... 10-2012-0095367
Nov. 20, 2012 (KR) ..... 10-2012-0131379

(51) Int. Cl.
*A47L 11/40* (2006.01)
*A47L 9/28* (2006.01)

(52) U.S. Cl.
CPC ..... *A47L 11/4069* (2013.01); *A47L 9/2873* (2013.01); *A47L 11/4011* (2013.01); *A47L 2201/00* (2013.01)

(58) Field of Classification Search
CPC . A47L 11/4011; A47L 11/4069; A47L 11/16; A47L 11/4058; A47L 11/4038; A47L 11/4075; A47L 9/2873
See application file for complete search history.

(56) References Cited

U.S. PATENT DOCUMENTS

2005/0166356 A1* 8/2005 Uehigashi ..... A47L 5/30 15/319
2006/0021168 A1* 2/2006 Nishikawa ..... A47L 9/009 15/49.1
2008/0282494 A1* 11/2008 Won ..... A47L 5/30 15/319
2012/0090133 A1* 4/2012 Kim ..... A47L 9/0411 15/391

* cited by examiner

*Primary Examiner* — Robert Scruggs
(74) *Attorney, Agent, or Firm* — Staas & Halsey LLP

(57) ABSTRACT

A side brush assembly including a side arm capable of being exposed outside a main body and returning inside the main body and a side brush unit mounted to the side arm, a robot cleaner and a control method of the robot cleaner is provided. The robot cleaner includes a main body and at least one side brush assembly to increase a dust-removing area. The side brush assembly includes a side brush body, a side arm mounted to a bottom surface of the side brush body and configured to be exposed outside the main body, a side brush unit rotatably mounted to the side arm, a lever configured to rotate together with the side arm, a cam configured to rotate by receiving driving force from a driving motor, and an elastic member connecting the lever and the cam to rotate the lever by elastic force thereof.

20 Claims, 22 Drawing Sheets

SIDE BRUSH ASSEMBLY, ROBOT CLEANER AND CONTROL METHOD OF ROBOT CLEANER

CROSS-REFERENCE TO RELATED APPLICATIONS

This application claims the priority benefit of Korean Patent Application Nos. 10-2012-0095367 and 10-2012-0131379, filed on Aug. 30, 2012 and Nov. 20, 2012, respectively, in the Korean Intellectual Property Office, the disclosures of which are incorporated herein by reference.

BACKGROUND

1. Field

Embodiments relate to a side brush assembly including a side arm capable of being exposed outside a main body and returning inside the main body and a side brush unit mounted to the side arm, a robot cleaner and a control method of the robot cleaner.

2. Description of the Related Art

A robot cleaner is an appliance that moves by itself by virtue of an automatic travel function to clean a room or the like by sucking up foreign materials, such as dust, from a floor of the room without user intervention. The robot cleaner detects a distance up to an obstacle, such as furniture, office supplies, walls or the like, present in a zone to be cleaned using a distance sensor, and changes a traveling direction by selectively driving a left-wheel motor and a right-wheel motor to perform cleaning of the zone to be cleaned.

The robot cleaner includes a brush unit to sweep and collect dust. In order to increase a cleaning area, the robot cleaner further includes a side brush assembly.

SUMMARY

In an aspect of one or more embodiments, there is provided a side brush assembly equipped with a side arm configured to be exposed outside a main body and return inside the main body and a side brush unit mounted to the side arm, and capable of preventing the side brush unit from being damaged by obstacles.

In an aspect of one or more embodiments, there is provided a robot cleaner capable of sweeping dust gathering in corners using the side brush unit exposed outside the main body and reliably returning the side arm inside the main body, and a control method of the robot cleaner.

In an aspect of one or more embodiments, there is provided a robot cleaner which includes a main body a main body to remove dust from a floor while traveling on the floor, and at least one side brush assembly provided at the main body in order to increase a dust-removing area on the floor. The side brush assembly includes a side brush body defining an appearance of the side brush assembly, a side arm mounted to a bottom surface of the side brush body and configured to be exposed outside the main body, a side brush unit rotatably mounted to the side arm, a lever connected to the side arm and configured to rotate together with the side arm, a cam configured to rotate by receiving driving force from a driving motor, and an elastic member connecting the lever and the cam in order to rotate the lever by elastic force thereof.

The side brush body may be formed with a through-hole, through which a shaft is inserted. The shaft inserted through the through-hole may pass through the side brush body and the lever to connect the same.

The side brush body may be formed with a slit near the through-hole.

The lever may be provided with a guide pin, and the guide pin may move along the slit as the lever rotates.

When the cam rotates by the driving motor, the guide pin may move along the slit in a first direction by elastic force of the elastic member, and the side arm may be exposed outside the main body.

If external force is applied in a direction of returning the side arm inside the main body in a state of being exposed outside the main body, the guide pin may move along the slit in a second direction opposite to the first direction. If the external force is removed, the guide pin may move along the slit in the first direction by elastic force of the elastic member, and the side arm may be restored to the state of being exposed outside the main body.

If external force is applied in a direction of exposing the side arm outside the main body in a state of being held inside the main body, the guide pin may move along the slit in a first direction. If the external force is removed, the guide pin may move along the slit in a second direction opposite to the first direction by elastic force of the elastic member, and the side arm may be restored to the state of being held inside the main body.

The lever may be provided with a locking part which is configured as a protrusion extending outward from the lever.

The locking part may be configured to interfere with the cam in a state that the side arm is held inside the main body. Although external force is applied in a direction of exposing the side arm outside the main body, the lever may be prevented from rotating by interference of the locking part with the cam.

The guide pin may be integrally formed with the lever.

The side brush assembly may be removably mounted to a bottom surface of the main body.

The side brush body may be formed with a coupling hole, and the side brush body may be coupled to the main body by a coupling member which is inserted through the coupling hole and the bottom surface of the main body.

The side arm may be provided with a driving shaft which is mounted to the side brush unit, and a side brush driving motor to supply driving force to the driving shaft to rotate the same.

In an aspect of one or more embodiments, there is provided a side brush assembly which includes a side brush body formed with an accommodating part, a driving motor accommodated in the accommodating part, a cam configured to rotate by receiving driving force from the driving motor, a lever rotatably provided at the side brush body, an elastic member connecting the cam and the lever and configured to rotate the lever by being stretched by rotation of the cam or external force, a side arm configured to integrally rotate with the lever, and a side brush unit rotatably mounted to the side arm.

The side arm and the lever may be respectively fixed to both ends of a shaft which is inserted through the side brush body.

If external force is applied, the side arm may rotate in a first direction. If the external force is removed, the side arm may rotate in a second direction opposite to the first direction and may return to an original position.

The lever may be provided with a locking part which is configured as a protrusion extending from the lever.

If the driving motor is inactivated and the cam does not rotate, rotation of the lever and the side arm may be prevented due to interference of the locking part with the cam.

The side brush body may be formed with a slit, and the lever may be provided with a guide pin which is configured to be guided by the slit.

The side arm may be limited in rotation in at least one direction by a length of the slit.

In an aspect of one or more embodiments, there is provided a robot cleaner which includes a main body to remove dust from a floor while traveling on the floor, a side brush body provided in the main body and having an accommodating part, a driving motor accommodated in the accommodating part, a cam configured to rotate by receiving driving force from the driving motor, a pressing part mounted to the cam and configured to integrally move with the cam, a side arm configured to be exposed outside the main body or return inside the main body by rotation of the cam, a control unit to control operation of the driving motor, and a sensor mounted to the side brush body and configured to detect whether the side arm completely returns inside the main body.

The sensor may include a switch, and when the side arm completely returns inside the main body, the pressing part may press the switch.

If the pressing part presses the switch, the sensor may transmit information that the side arm completely returns inside the main body to the control unit.

The control unit may store the preset number of steps of the driving motor which operates to expose or return the side arm.

When the side arm returns inside the main body, if the switch is not pressed after the driving motor rotates the preset number of steps, the control unit may determine that the side arm interferes with obstacles.

In an aspect of one or more embodiments, there is provided a control method of a robot cleaner which includes driving a driving motor to rotate a side arm so that the side arm returns inside a main body, determining whether the driving motor is driven the preset number of steps, determining whether a switch is pressed by the side arm, determining whether a waiting time is over in an inactivated state of the driving motor, driving the driving motor to rotate the side arm so that the side arm returns inside the main body, and determining whether the switch is pressed.

The determining whether the switch is pressed by the side arm may include determining that the side arm completely returns inside the main body upon determining that the switch is pressed by the side arm, and terminating return operation of the side arm.

The determining whether the waiting time is over in an inactivated state of the driving motor may include removing obstacles interfering with the side arm by rotational or linear movement of the robot cleaner within the waiting time.

The driving the driving motor to rotate the side arm so that the side arm returns inside the main body and the determining whether the switch is pressed may be repeated upon determining that the switch is not pressed.

In an aspect of one or more embodiments, there is provided a control method of a robot cleaner which includes driving a driving motor to rotate a side arm so that the side arm is exposed outside a main body, determining whether the driving motor is driven the preset number of steps, and stopping driving of the driving motor.

As described above, since the side arm equipped with the side brush unit may be exposed outside the main body, a cleaning area may be widened. In addition, the side brush unit may be prevented from being damaged due to interference with external obstacles and being forcibly and unexpectedly exposed by external obstacles in the state of being held inside the main body. Further, the performance of detecting whether the side arm completely returns inside the main body may prevent an operational error that the return operation of the side arm is stopped before the side arm completely returns inside the main body.

In an aspect of one or more embodiments, there is provided a control method of a robot cleaner which includes driving a driving motor to rotate a motor shaft to rotate a side arm so that the side arm is returned inside a main body of the robot cleaner; determining whether the driving motor is driven a present number of steps in a direction of returning the side arm inside the main body of the robot cleaner; stopping driving of the driving motor after the driving motor is driven the preset number of steps; determining whether a switch is pressed; when the switch is not pressed, determining whether a wait time has expired; when the switch is not pressed and the wait time has expired, driving the driving motor to rotate the motor shaft by a preset unit angle in a direction of the returning side arm; and stopping the rotation of the motor shaft upon detection of the pressed switch.

In an aspect of one or more embodiments, there is provided a control method of a robot cleaner which includes driving a driving motor to rotate a side arm so that the side arm returns inside a main body; determining whether the driving motor is driven a preset number of steps; determining whether a switch is pressed by the side arm after the driving motor is driven the present number of steps; determining whether a waiting time is over in an inactivated state of the driving motor; driving the driving motor to rotate the side arm so that the side arm returns inside the main body when the switch is not pressed and the wait time has expired; and stopping the rotation of the side arm upon detection of the pressed switch.

BRIEF DESCRIPTION OF THE DRAWINGS

These and/or other aspects of embodiments will become apparent and more readily appreciated from the following description of embodiments, taken in conjunction with the accompanying drawings of which.

DETAILED DESCRIPTION

Figure 1A:
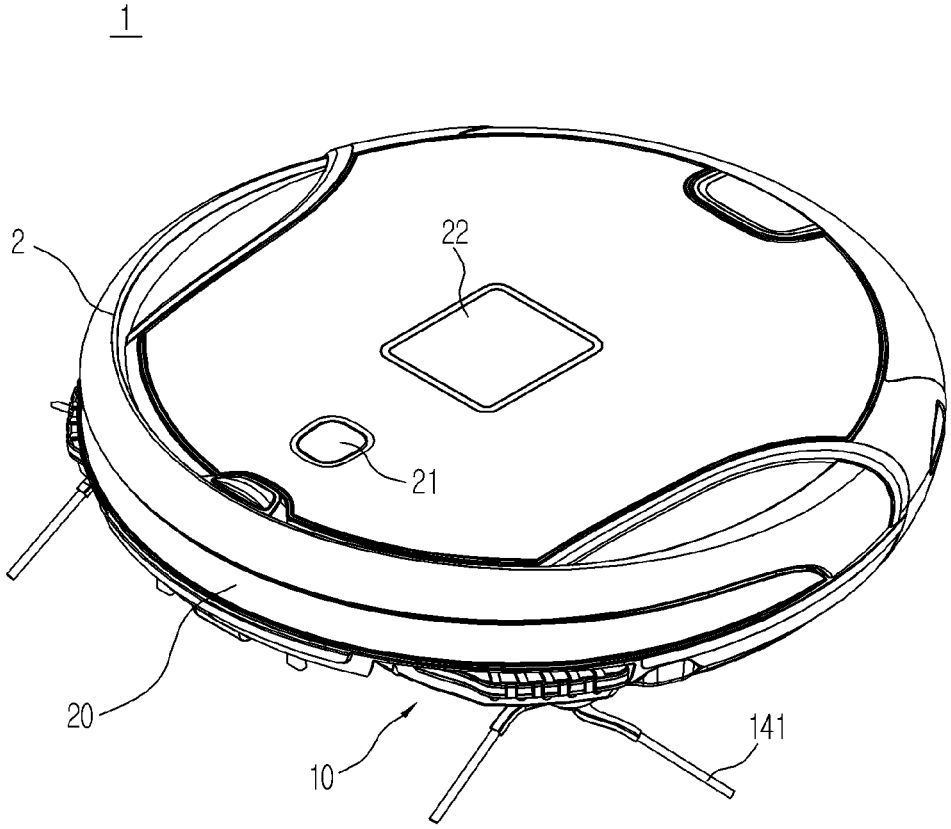
FIGS. 1*a* and 1*b* are perspective views illustrating a robot cleaner according to an embodiment.

Reference will now be made in detail to embodiments, examples of which are illustrated in the accompanying drawings, wherein like reference numerals refer to like elements throughout.

Figure 1B:
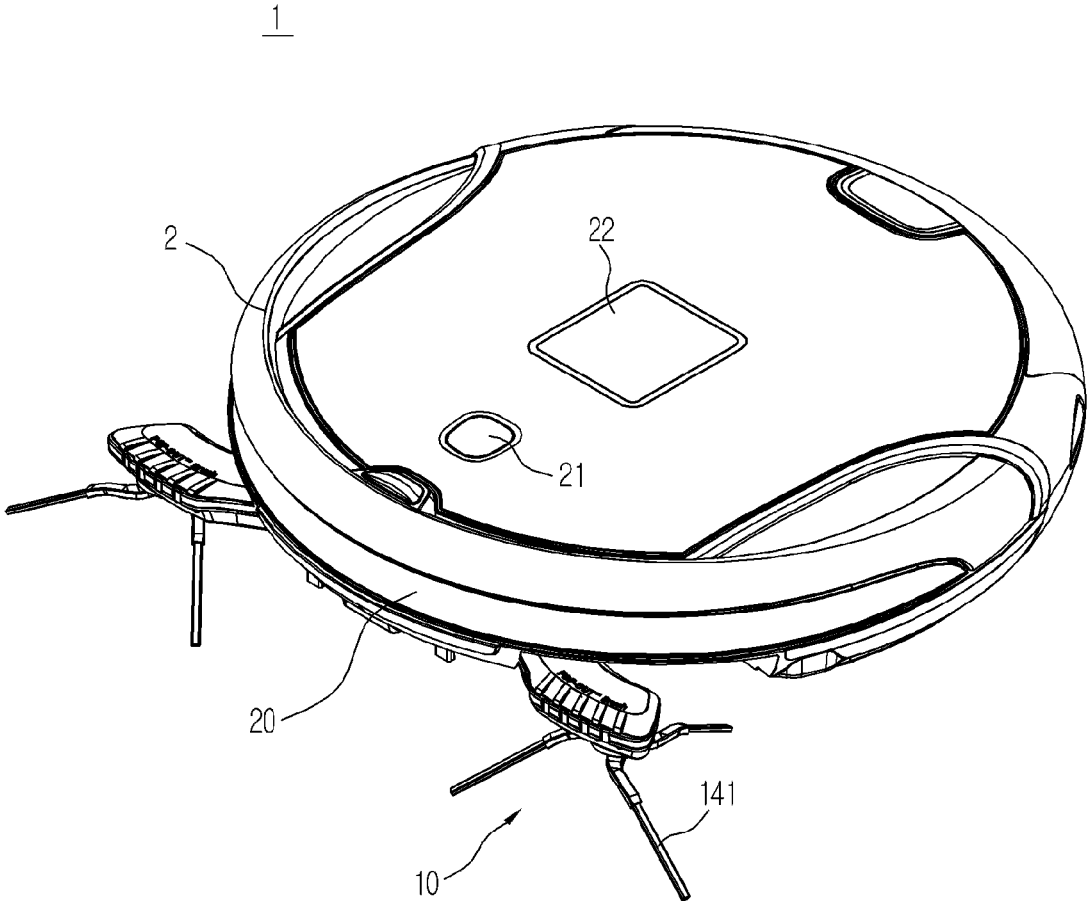
Figure 2A:
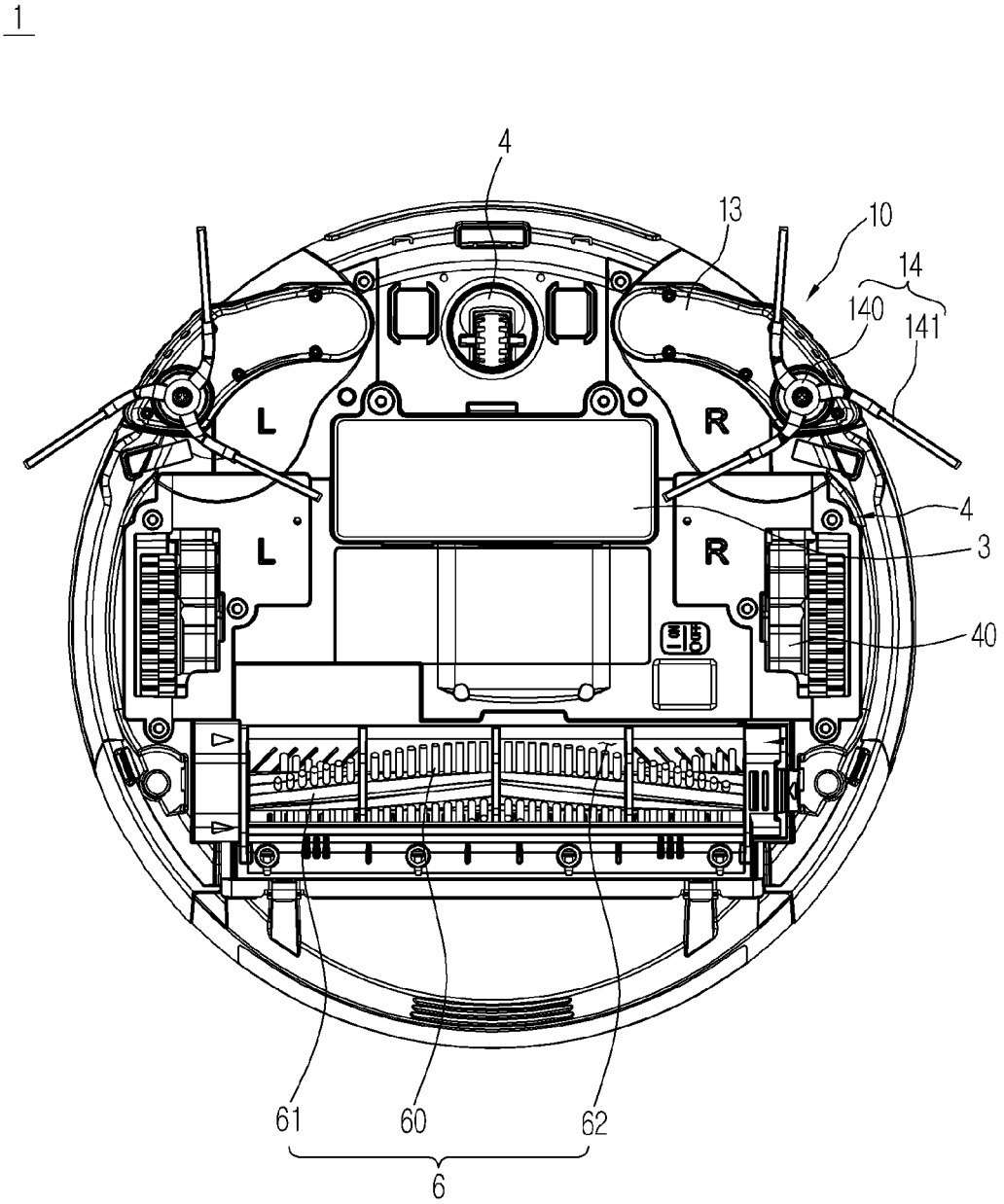
FIGS. 2*a* and 2*b* are bottom views illustrating the robot cleaner according to an embodiment.
Figure 2B:
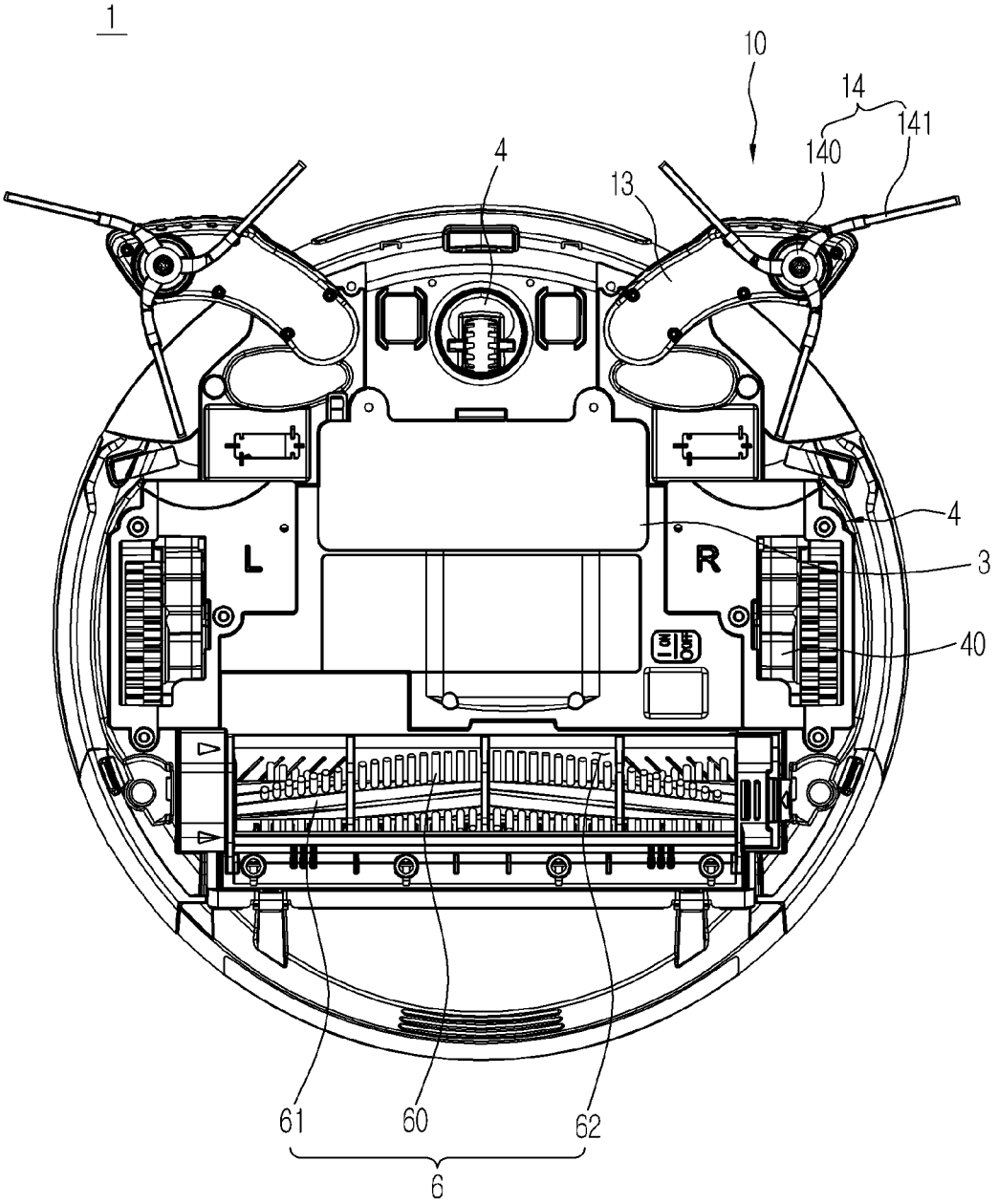
Figure 3:
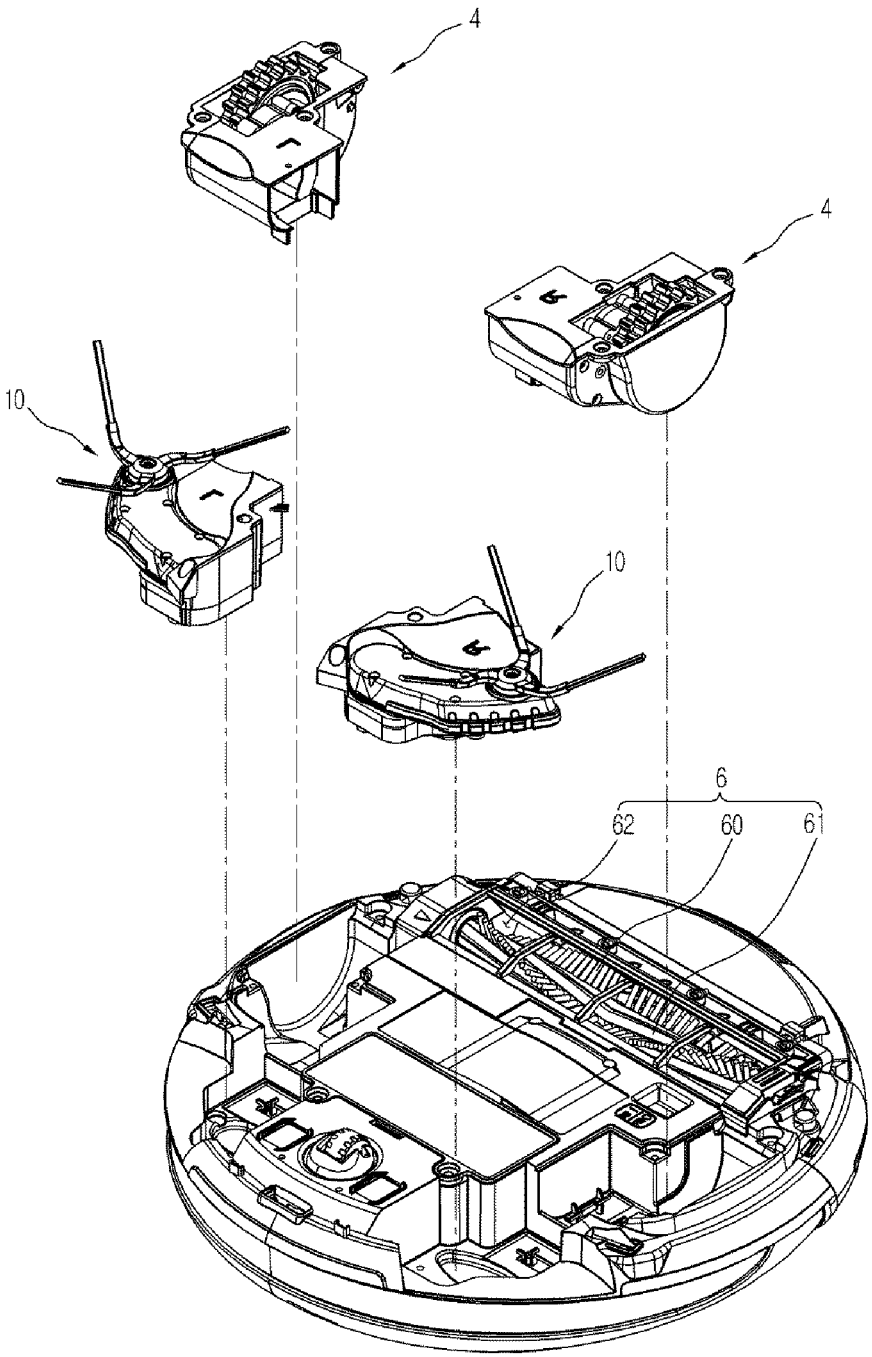
FIG. 3 is a view illustrating a side brush assembly of the robot cleaner according to an embodiment.

FIGS. 1*a* and 1*b* are perspective views illustrating a robot cleaner according to an embodiment, FIGS. 2*a* and 2*b* are bottom views illustrating the robot cleaner according to an embodiment, and FIG. 3 is a view illustrating a side brush assembly of the robot cleaner according to an embodiment.

As shown in FIGS. 1*a* through 3, a robot cleaner 1 according to an embodiment includes a main body 2, a power unit 3, a driving wheel assembly 4, a caster 5, a main brush unit 6, and a side brush assembly 10.

The power unit 3 supplies driving power to drive the main body 2. The power unit 3 includes a battery electrically connected to driving devices in order to supply driving power to the same to drive the main body 2 and components installed to the main body 2. The battery may be configured as a secondary or rechargeable battery. If the main body 2 is connected to a docking station (not shown) after cleaning, the battery may be recharged at the docking station.

The driving wheel assembly 4 may be provided in a pair of assemblies which are disposed at a bottom surface of the main body 2 and are symmetrically arranged at a left middle area and a right middle area near an edge of the main body 2. The driving wheel assembly 4 includes a driving wheel 40 enabling the main body 2 to move forward and backward and rotate during cleaning operation. The driving wheel assembly 4 may be modularized so as to be removably mounted to the bottom surface of the main body 2. Therefore, if the driving wheel 40 needs repair or replacement due to breakdown or the like, only the driving wheel assembly 4 may be removed from the bottom surface of the main body 2 for repair or replacement without disassembling the main body 2. The driving wheel assembly 4 may be mounted to the bottom surface of the main body 2 using hook engagement, screw engagement, tight-fitting engagement or the like.

On the basis of a traveling direction, the caster 5 is mounted to a front area near the edge of the bottom surface of the main body 2. The caster 5 enables the main body 2 to maintain a stable posture. The caster 5 may be provided integrally with the driving wheel assembly 4 in a unitary assembly.

The main brush unit 6 is mounted to a suction port 62 formed at the bottom surface of the main body 2. The main brush unit 6 includes a main brush 60 and a roller 61. The main brush 60 is provided at an outer surface of the roller 61. As the roller 61 rotates, the main brush 60 sweeps dust on a floor and guides the same toward the suction port 62. The roller 61 may be configured as a rigid body, however, it is not limited to this configuration. The main brush 60 may be made of various materials having elasticity.

Although not illustrated in the drawings, a suction device is provided in the suction port 62 to generate suction force. Dust sucked into the suction port 62 moves toward a dust collecting device (not shown).

Sensors 20 and 21 may be mounted to the main body 2. The sensors 20 and 21 may include a proximity sensor 20 and a vision sensor 21. If the robot cleaner 1 arbitrarily travels without a preset traveling path under a cleaning system without a map, the robot cleaner 1 may travel on a zone to be cleaned using the proximity sensor 20. If the robot cleaner 1 travels along a preset traveling path under a cleaning system with a map, the vision sensor 21 may receive position information of the robot cleaner 1 and generate a map. The vision sensor 21 is an exemplary embodiment of a position sensing system, and the position sensing system may be embodied by various other types of sensors.

A display unit 22 may be provided at a portion of the main body 2. The display unit 22 may display states of the robot cleaner 1, such as whether the battery is fully recharged or not, whether the dust collecting device is filled with dust or not, whether the robot cleaner 1 is in a cleaning mode or a sleep mode, and the like.

The side brush assembly 10 may be modularized so as to be removably mounted to the bottom surface of the main body 2. Therefore, if the side brush assembly 10 needs repair or replacement due to breakdown or the like, only the side brush assembly 10 may be removed from the main body 2 for repair or replacement without disassembling the main body 2. The side brush assembly 10 may be mounted to the bottom surface of the main body 2 using hook engagement, screw engagement, tight-fitting engagement or the like. The side brush assembly 10 may be provided in two or more separate assemblies which are disposed apart with a certain gap therebetween at the bottom surface of the main body 2.

The side brush assembly 10 includes a side arm 13 and a side brush unit 14. The side brush unit 14 may be mounted to the side arm 13. The side arm 13 may be configured to be exposed outside the main body 2 and return inside the main body 2. The side brush unit 14 includes a rotating shaft 140 and a side brush 141. The side brush 141 rotates about the rotating shaft 140, and sweeps dust on a floor, on which the robot cleaner 1 travels, toward the suction port 62.

Constitution of the side brush assembly 10 will now be explained.

Figure 4:
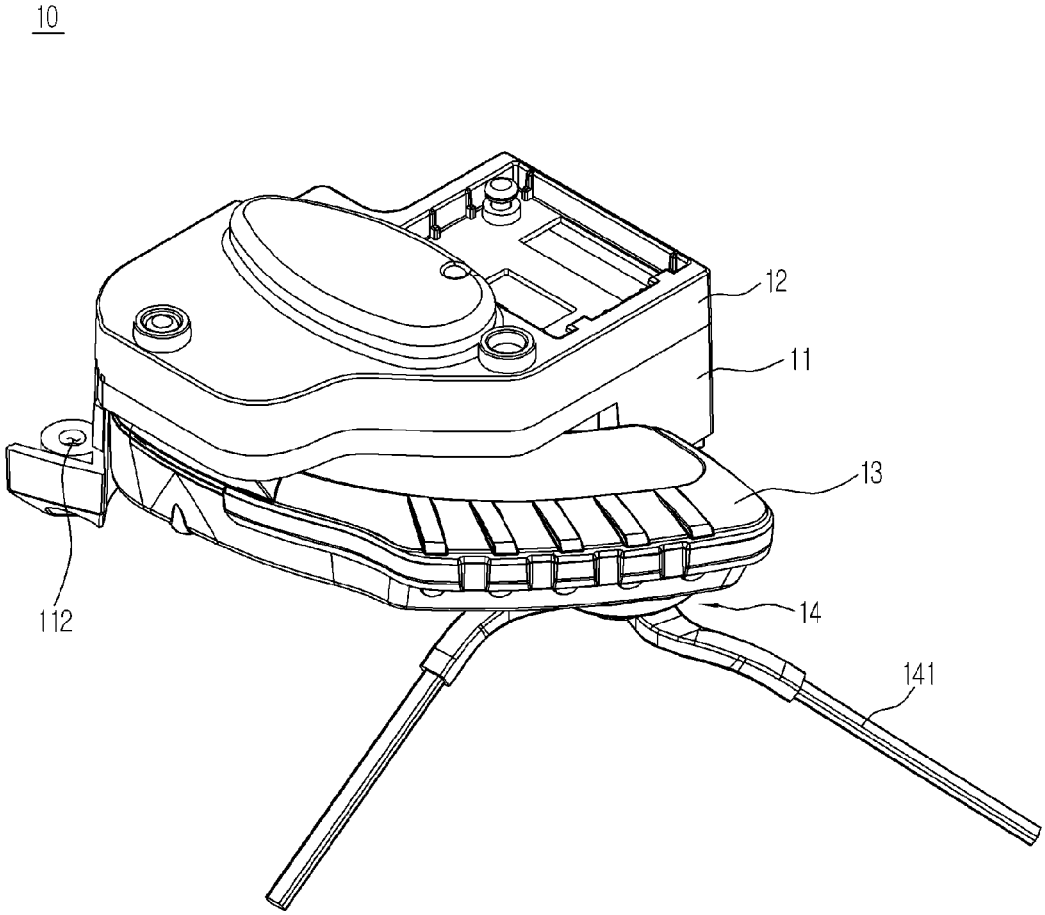
FIG. 4 is a perspective view illustrating a side brush assembly according to an embodiment.
Figure 5:
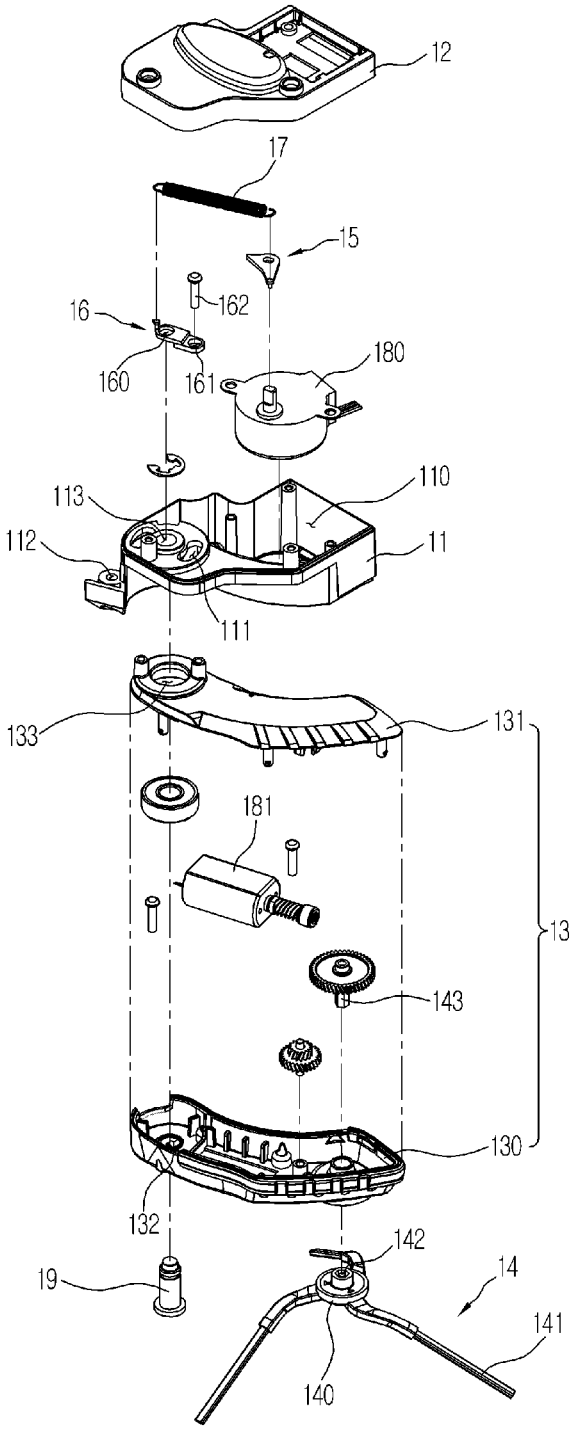
FIG. 5 is an exploded perspective view of the side brush assembly according an embodiment.
Figure 6:
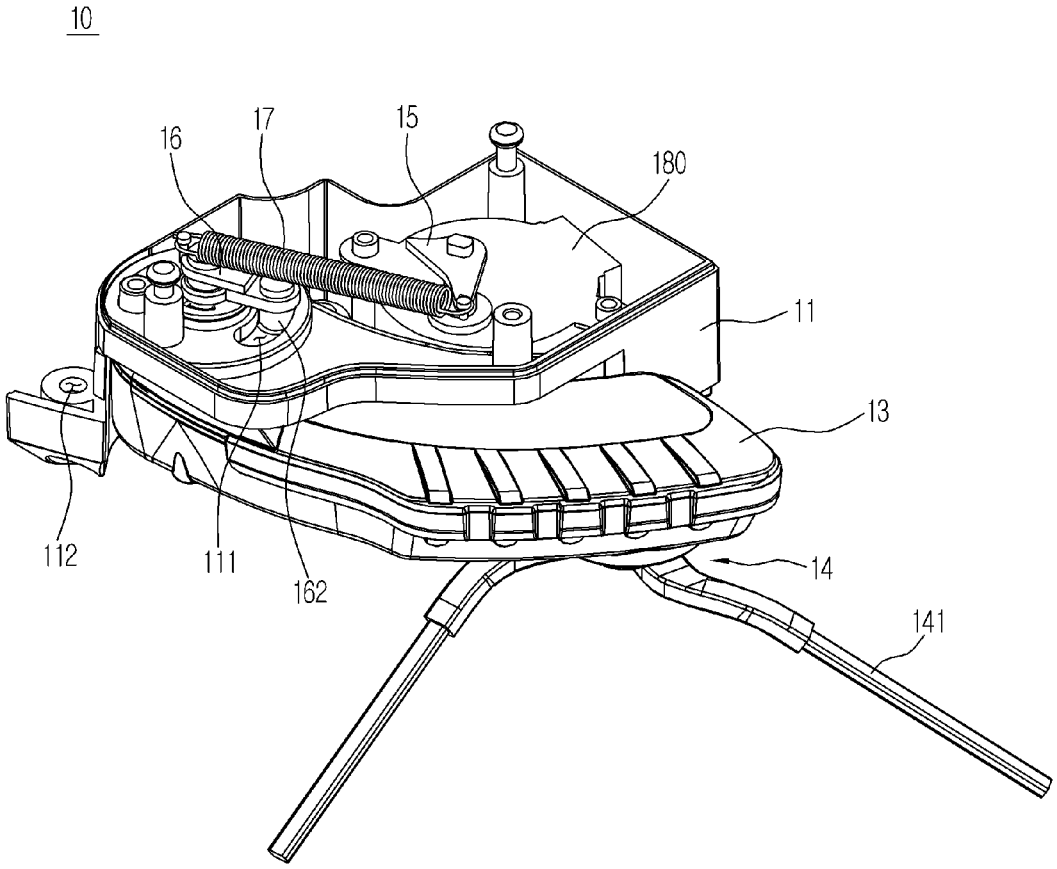
FIG. 6 is a view illustrating the side brush assembly with a cover removed according to an embodiment.

FIG. 4 is a perspective view illustrating a side brush assembly according to an embodiment, FIG. 5 is an exploded perspective view of the side brush assembly according to an embodiment, and FIG. 6 is a view illustrating the side brush assembly with a cover removed according to an embodiment.

Referring to FIGS. 4 through 6, a side brush assembly 10 according to an embodiment includes a side brush body 11, a cover 12, a side arm 13 and a side brush unit 14. The side brush body 11 has an opened portion at an upper surface thereof, which may be shielded by the cover 12. The side arm 13 may be mounted to the side brush body 11, and the side brush unit 14 may be mounted to the side arm 13.

The side brush body 11 is formed with an accommodating part 110, which accommodates a side arm driving motor 180 therein. A cam 15, a lever 16 and an elastic member 17 are mounted to the side brush body 11. The cam 15, the lever 16 and the elastic member 17 may be accommodated in the accommodating part 110 of the side brush body 11.

The cam 15 is coupled to the side arm driving motor 180. The side arm driving motor 180 may transmit driving force to the cam 15, and the cam 15 may rotate clockwise or counterclockwise.

The lever 16 is mounted to the side brush body 11, and is formed with a hole 160 through which a shaft 19 is inserted. The side brush body 11 is formed with a through-hole 113 corresponding to the hole 160 of the lever 16. By the shaft 19 being inserted through the hole 160 and the through-hole 113, the lever 16 may be rotatably mounted to the side brush body 11.

The lever 16 may be provided with a guide pin 162. The lever 16 may be formed with a guide pin insertion hole 161 through which the guide pin 162 is inserted. The guide pin 162 inserted through the guide pin insertion hole 161 extends downward from a bottom surface of the lever 16. The guide pin 162 may be formed integrally with the lever 16.

The side brush body 11 may be formed with a slit 111. The guide pin 162 is inserted through the slit 111, and moves along the slit 111. The slit 111 is located near the through-hole 113 so that the guide pin 162 inserted through the slit 111 may move along the slit 111 when the lever 16 rotates about the shaft 19. A radius of rotation of the side arm 13 may be set in accordance with a length of the slit 111. That is, the side arm 13 may be limited in rotation in at least one direction by the length of the slit 111.

A coupling hole 112 is formed at a portion of the side brush body 11. The side brush body 11 may be coupled to the main body 2 by a coupling member (not shown) which is inserted through the coupling hole 112 and the main body 2. In detail, a coupling part provided with a thread, through which the coupling member is engaged, is formed at the bottom surface of the main body 2. The coupling member is engaged through both the coupling hole 112 of the side brush body 11 and the coupling part of the main body 2, to thereby couple the side brush assembly 10 to the bottom surface of the main body 2. The coupling between the side brush body 11 and the main body 2 is not limited to this configuration, and may be achieved by various other methods, such as hook engagement or the like. The side brush assembly 10 may be separated from the main body 2 only by releasing the coupling member coupling the side brush body 11 to the main body 2 or releasing the hook engagement of the side brush body 11, without disassembling the main body 2.

The side arm 13 is mounted to a bottom surface of the side brush body 11. The side arm 13 includes a side arm body 130 and a side arm cover 131. The side brush unit 14 is mounted to a bottom surface of the side arm body 130.

The side arm body 130 and the side arm cover 131 are formed with holes 132 and 133, respectively, which are located corresponding to each other. The shaft 19 may be inserted through the hole 132 of the side arm body 130 and the hole 133 of the side arm cover 131. Accordingly, the shaft 19 may pass through the holes 132 and 133 of the side arm 13, the through-hole 113 of the side brush body 11, and the hole 160 of the lever 16. The shaft 19 may be fixed to the side arm 13 and the lever 16 so that the side arm 13 and the lever 16 may integrally move. For example, the shaft 19 may be provided with a thread at an outer side surface thereof, and the holes 132 and 133 of the side arm 13 or the hole 160 of the lever 16 may be provided with a thread at an inner side surface thereof, with which the thread of the shaft 19 may be engaged. Alternatively, both ends of the shaft 19 may be fixed by a coupling member. As a result, the lever 16 and the side arm 13 may integrally move.

The elastic member 17 connects the cam 15 and the lever 16. An end of the elastic member 17 is coupled to a portion of the cam 15, and the other end of the elastic member 17 is coupled to a portion of the lever 16. According to movement of the cam 15 and the side arm 13, the elastic member 17 transmits elastic force to the lever 16. The elastic member 17 may be stretched by rotation of the cam 15 or rotation of the side arm 13 by external force exerted on the side arm 13. If external force exerted on the side arm 13 is removed, the side arm 13 may return to an original position thereof by elastic restoring force of the elastic member 17. Detailed explanation related to this operation will be described later. On the basis of the position of the hole 160 of the lever 16, the elastic member 17 is coupled to one side portion of the lever 16, and the guide pin 162 is coupled to the opposite side of the lever 16.

The side brush unit 14 includes a side brush mounting part 140 and a side brush 141. The side brush 141 may be provided in plural separate brushes which are mounted to the side brush mounting part 140. The side brush mounting part 140 is formed with a driving shaft insertion hole 142.

The side arm body 130 is formed with a hole 134 corresponding to the driving shaft insertion hole 142 of the side brush mounting part 140. A driving shaft 143 is inserted through the hole 134 of the side arm body 130 and the driving shaft insertion hole 142 of the side brush mounting part 140. The driving shaft 143 is provided with a thread at a lower outer circumferential surface thereof, and the driving shaft insertion hole 142 is provided with a thread at an inner side surface thereof so that the thread of the driving shaft 143 may be tooth-engaged with the thread of the driving shaft insertion hole 142.

A gear part may be provided at an upper portion of the driving shaft 143. A side brush driving motor 181 may be accommodated in the side arm body 130. The gear part provided at the driving shaft 143 may be engaged with the side brush driving motor 181. The driving shaft 143 may rotate by being driven by the side brush driving motor 181. Accordingly, the side brush unit 14 may rotate by the side brush driving motor 181.

Hereinafter, operation of the side brush assembly 10 according to an embodiment will be described.

FIGS. 7 through 10 are views illustrating operation of the side brush assembly according to an embodiment.

Figure 7:
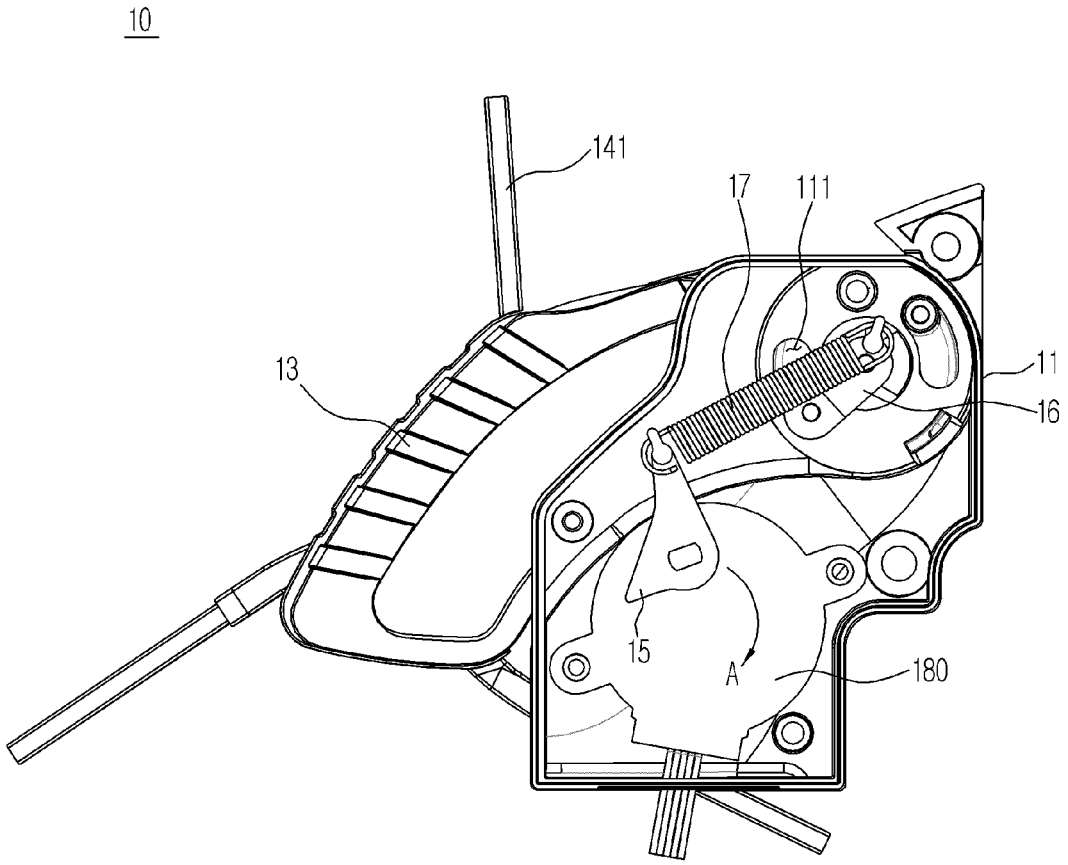
FIGS. 7 through 10 are views illustrating operation of the side brush assembly according to an embodiment.
Figure 8:
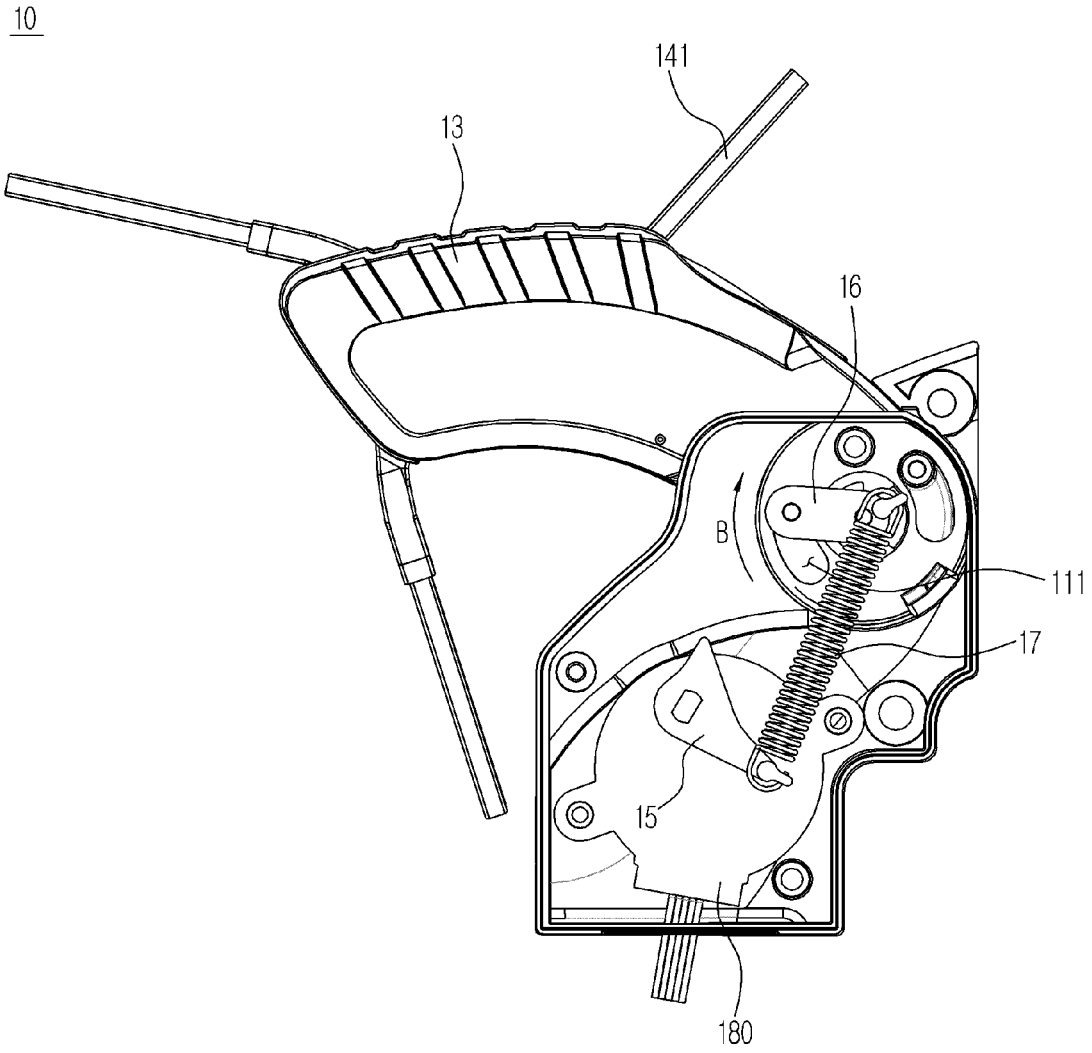

FIG. 7 is a view illustrating the side brush assembly 10 in an initial state, in which the driving motor 180 is inactivated and the side arm 13 is free from external force. If the driving motor 180 is driven and the cam 15 rotates clockwise (in a direction A), a distance between the portion of the lever 16 and the portion of the cam 15, to which both ends of the elastic member 17 are respectively coupled, increases, and thus the elastic member 17 is stretched. Due to elastic restoring force of the elastic member 17, as shown in FIG. 8, the opposite portion of the lever 16 to the elastic member 17 rotates clockwise (in a direction B) about the shaft 19. The guide pin 162 provided at the opposite portion of the lever 16 moves along the slit 111 of the side brush body 11. As the lever 16 rotates clockwise, the side arm 13 coupled to the lever 16 also rotates clockwise (in the direction B) and is exposed outside the main body 2. When the guide pin 162 arrives at one end of the slit 111, rotation of the side arm 13 stops and the elastic member 17 is restored to the initial state.

Accordingly, the side arm 13 may be exposed outside the main body 2 by the driving motor 180. In such an exposed state of the side arm 13, the side brush unit 14 rotates and sweeps dust around the main body 2 or dust gathering in the corners of the floor toward the suction port 62.

Figure 9:
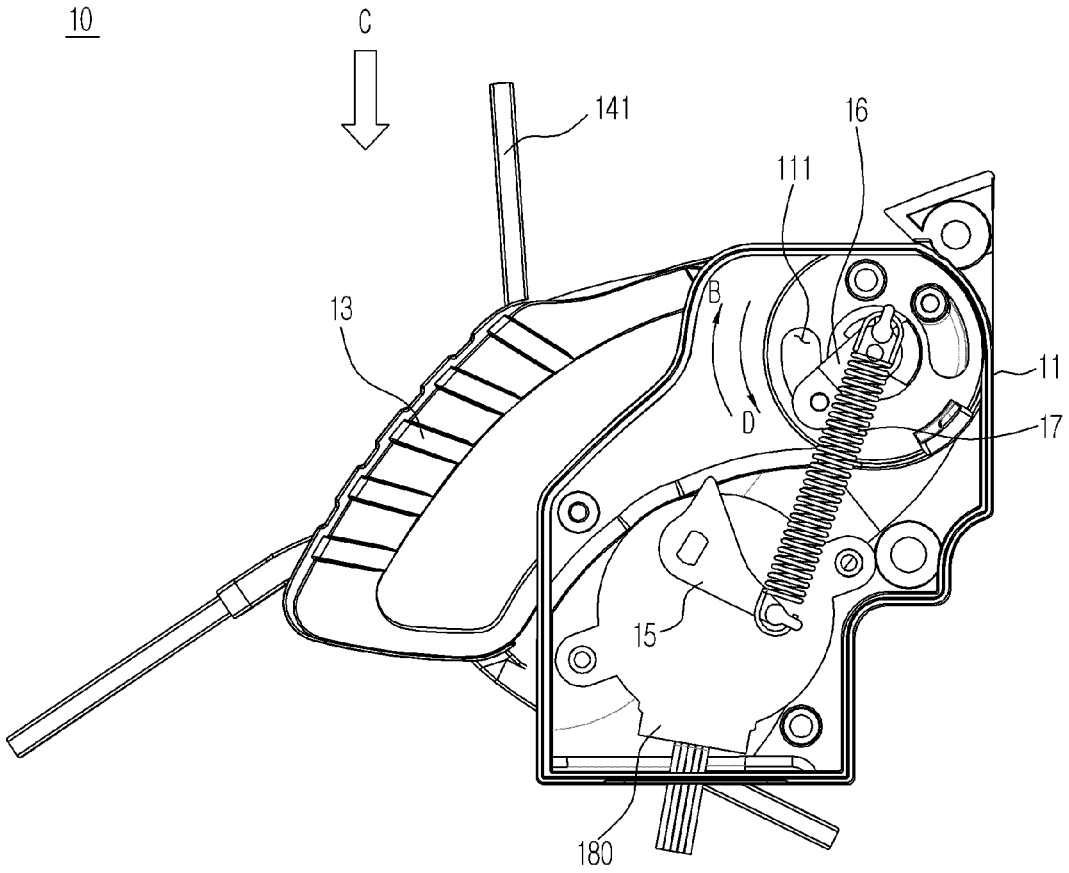
Figure 10:
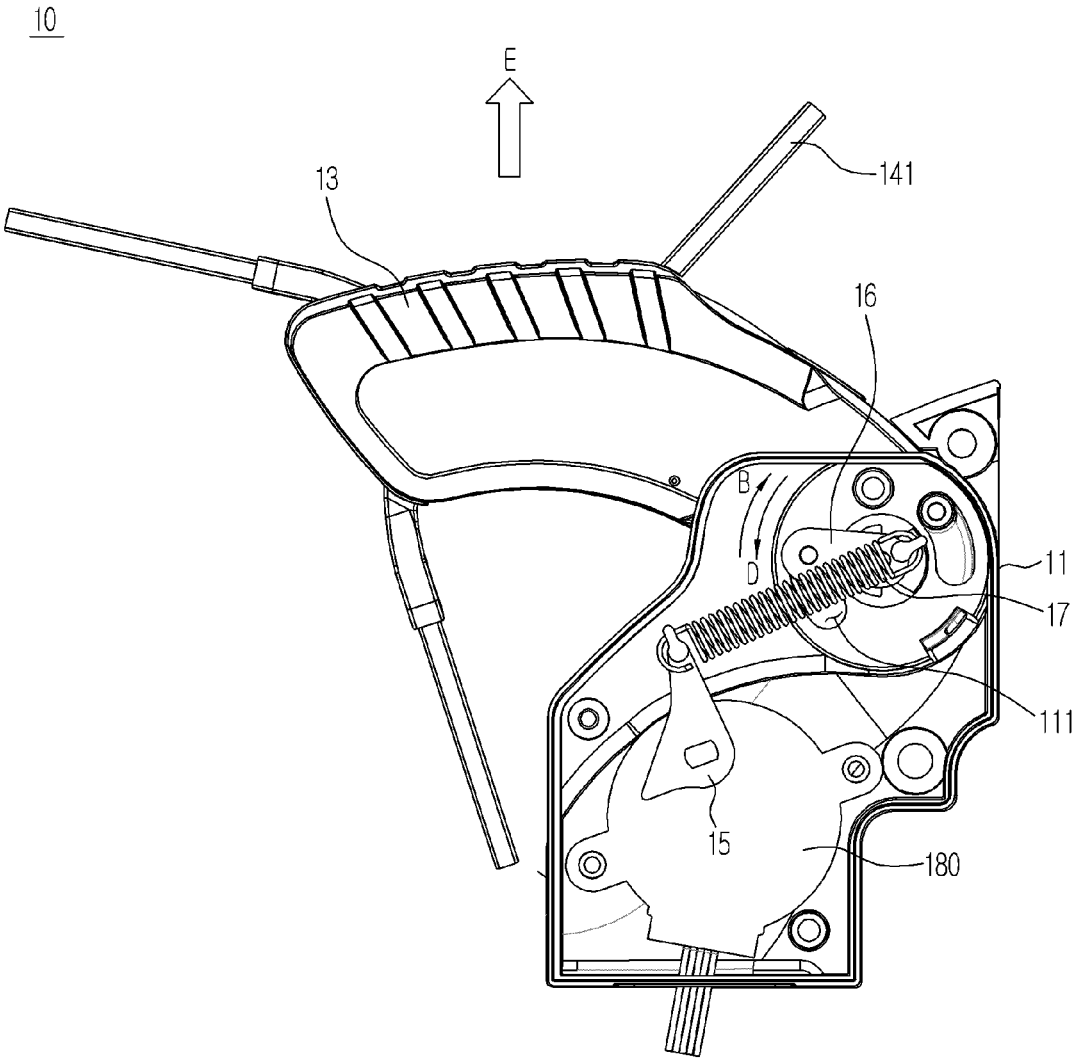

As shown in FIG. 9, if external force due to contact with obstacles is applied to the side arm 13 in a direction C while the side arm 13 is in an exposed state by the driving motor 180, the side arm 13 rotates counterclockwise (in a direction D) and returns inside the main body 2. As the side arm 13 rotates counterclockwise (in the direction D), the lever 16 also rotates counterclockwise (in the direction D) about the shaft 19. If the side arm 13 completely returns inside the main body 2, the guide pin 162 may be positioned at the other end of the slit 111. At this time, the distance between the portion of the lever 16 and the portion of the cam 15, to which both ends of the elastic member 17 are respectively coupled, increases, and thus the elastic member 17 is stretched. If external force due to contact with obstacles is removed, the lever 16 rotates clockwise (in the direction B) by elastic restoring force of the elastic member 17. As the lever 16 rotates clockwise (in the direction B), the side arm 13 also rotates clockwise (in the direction B), and is restored to the original state and exposed outside the main body 2 again.

In the initial state depicted in FIG. 7, if external force is applied to the side arm 13 in a direction E by which the side arm 13 is unexpectedly exposed outside the main body 2, the side arm 13 rotates clockwise (in the direction B). As the side arm 13 rotates clockwise (in the direction B), the lever 16 also rotates clockwise (in the direction B). The guide pin 162 provided at the lever 16 may move to one end of the slit 111 along the same. At this time, the distance between the portion of the lever 16 and the portion of the cam 15, to which both ends of the elastic member 17 are respectively coupled, increases, and thus the elastic member 17 is stretched. If external force in the direction E is removed, the lever 16 rotates counterclockwise (in the direction D) by elastic restoring force of the elastic member 17. As the lever 16 rotates counterclockwise (in the direction D), the side arm 13 also rotates counterclockwise (in the direction D), and returns inside the main body 2. As a result, the side arm 13 may be restored to the initial state.

As described above, although interference with obstacles occurs, the side arm 13 may return to an original position thereof by elastic force of the elastic member 17 immediately when external force is removed.

Figure 11:
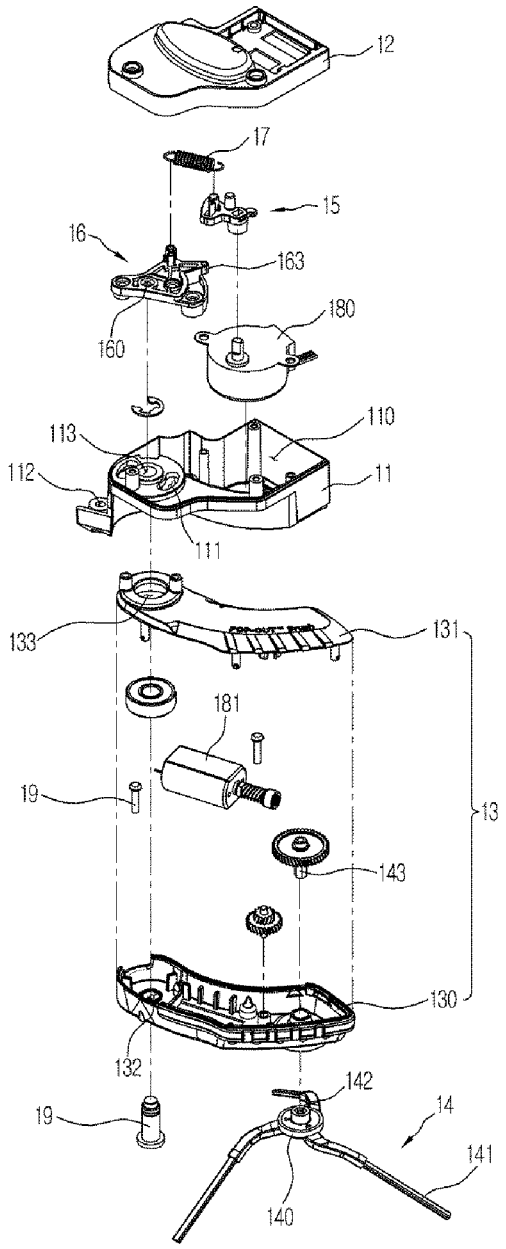
FIG. 11 is an exploded perspective view of a side brush assembly according an embodiment.
Figure 12:
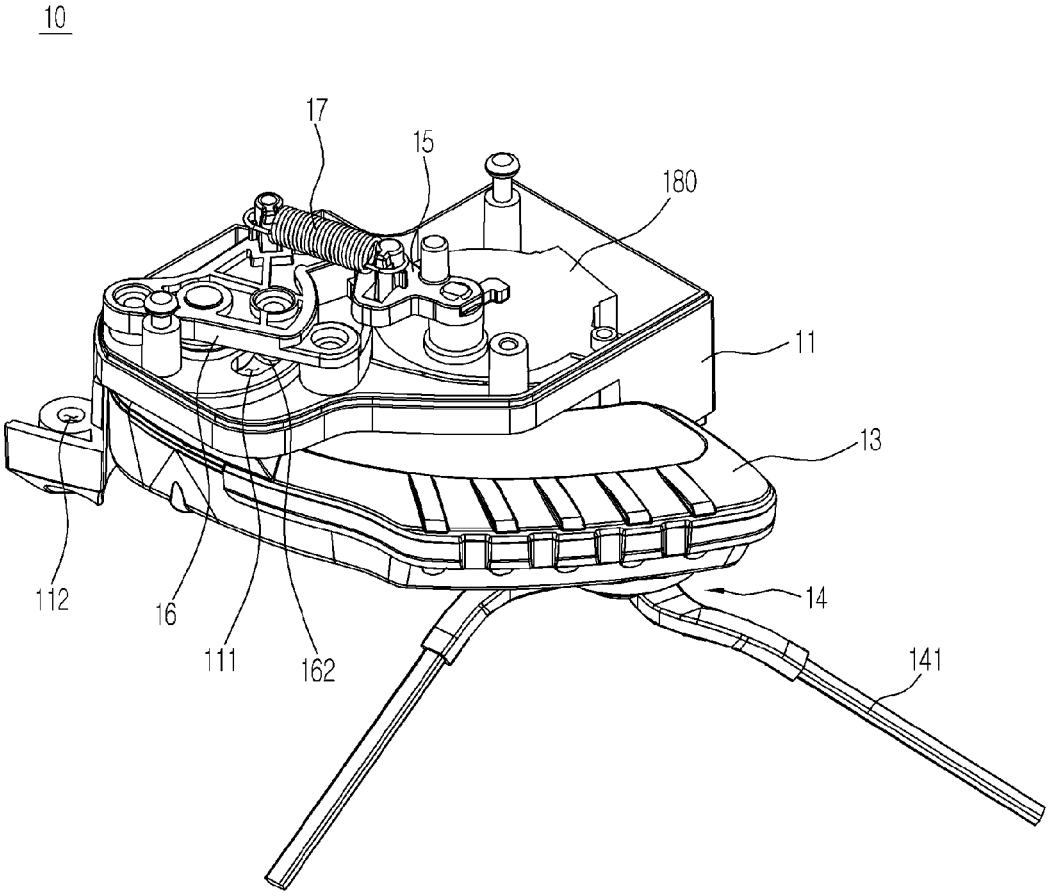
FIG. 12 is a view illustrating the side brush assembly with a cover removed according to an embodiment.

FIG. 11 is an exploded perspective view of a side brush assembly according to an embodiment, and FIG. 12 is a view illustrating the side brush assembly with a cover removed according to an embodiment.

Referring to FIGS. 11 and 12, a side brush assembly 10 according to an embodiment includes a side brush body 11, a cover 12, a side arm 13 and a side brush unit 14. The side brush body 11 has an opened portion at an upper surface thereof, which may be shielded by the cover 12. The side arm 13 may be mounted to the side brush body 11, and the side brush unit 14 may be mounted to the side arm 13.

The side brush body 11 is formed with an accommodating part 110, which accommodates a side arm driving motor 180 therein. A cam 15, a lever 16 and an elastic member 17 are mounted to the side brush body 11. The cam 15, the lever 16 and the elastic member 17 may be accommodated in the accommodating part 110 of the side brush body 11.

Constitution of the side brush body 11, the cover 12, the side arm 13 and the side brush unit 14 may be the same as that in the side brush assembly 10 according to an embodiment. Hereinafter, constitution of the lever 16 of the side brush assembly 10 according to an embodiment will be explained in detail.

The lever 16 according to an embodiment may be provided integrally with a guide pin 162. The guide pin 162 may protrude from a bottom surface of the lever 16. Similarly to the first embodiment, the guide pin 162 may be separately provided and coupled to the lever 16.

The lever 16 may be provided with a locking part 163. The locking part 163 may be configured as a protrusion extending outward from the lever 16. While the side arm 13 is held inside the main body 2, the locking part 163 may interfere with a portion of the cam 15. So long as the driving motor 180 is inactivated and the cam 15 does not rotate in the initial state, the locking part 163 interferes with the cam 15. Since the locking part 163 interferes with a portion of the cam 15 in the initial state in which the side arm 13 is held inside the main body 2, the lever 16 may not rotate in spite of external force. Accordingly, the side arm 13 is kept in the initial state without being exposed outside the main body 2.

Hereinafter, operation of the side brush assembly 10 according to an embodiment will be described.

Figure 13:
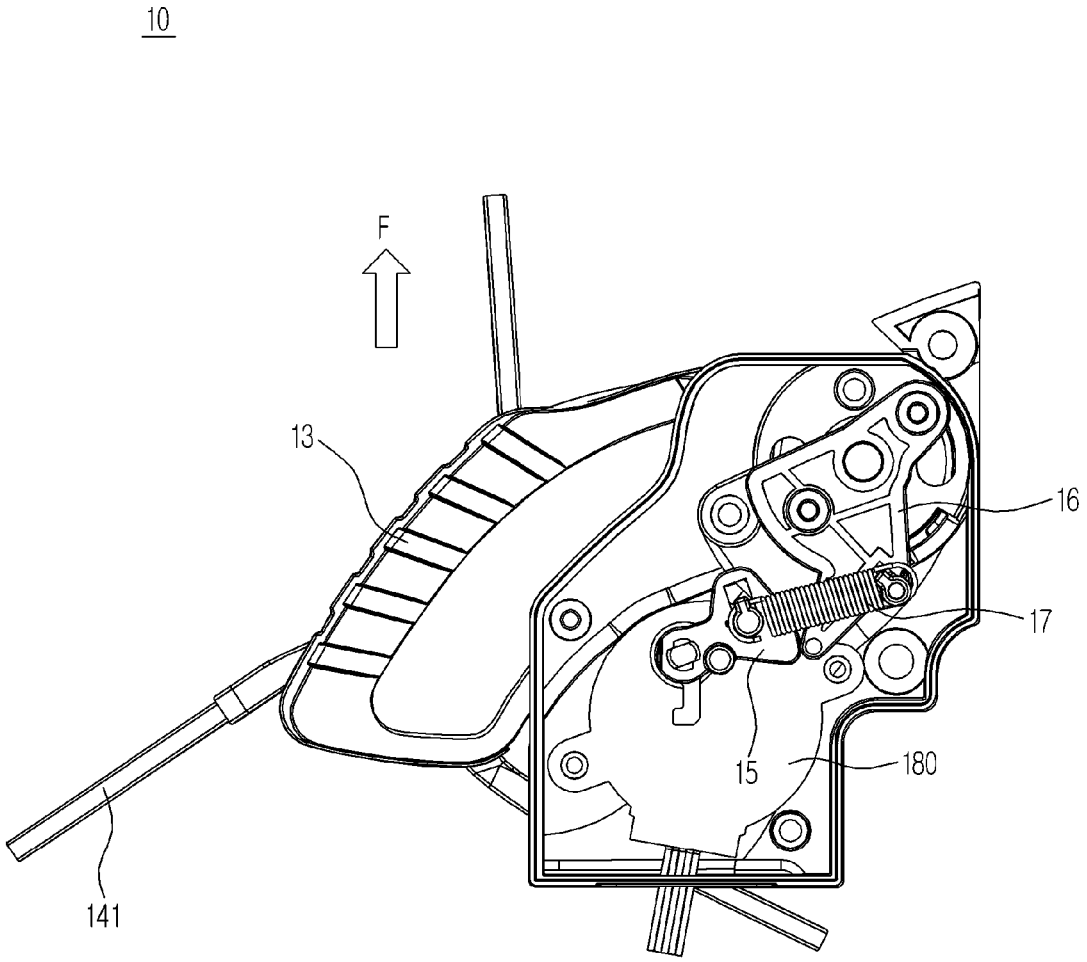
FIGS. 13 through 15 are views illustrating operation of the side brush assembly according to an embodiment.
Figure 14:
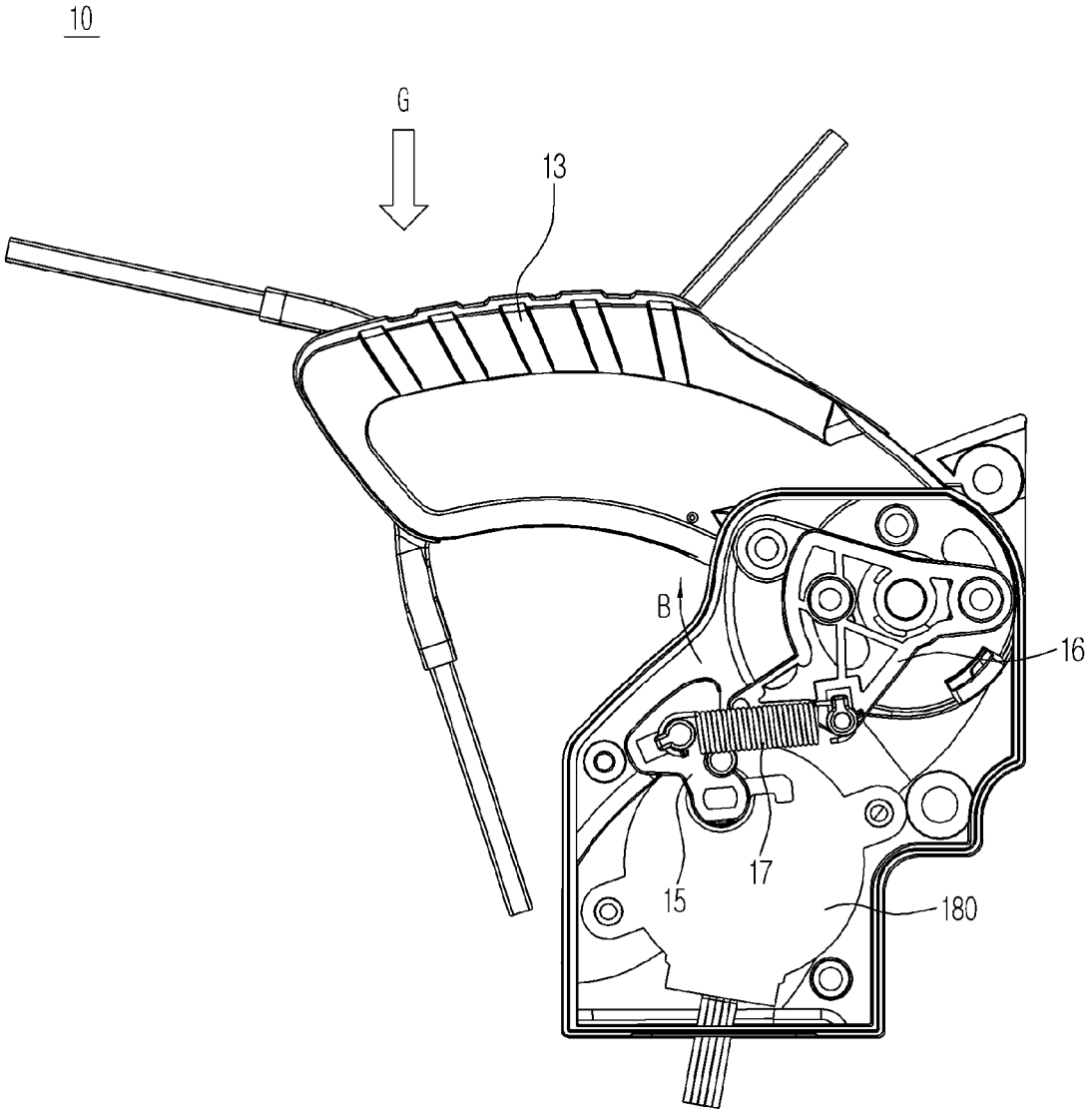
Figure 15:
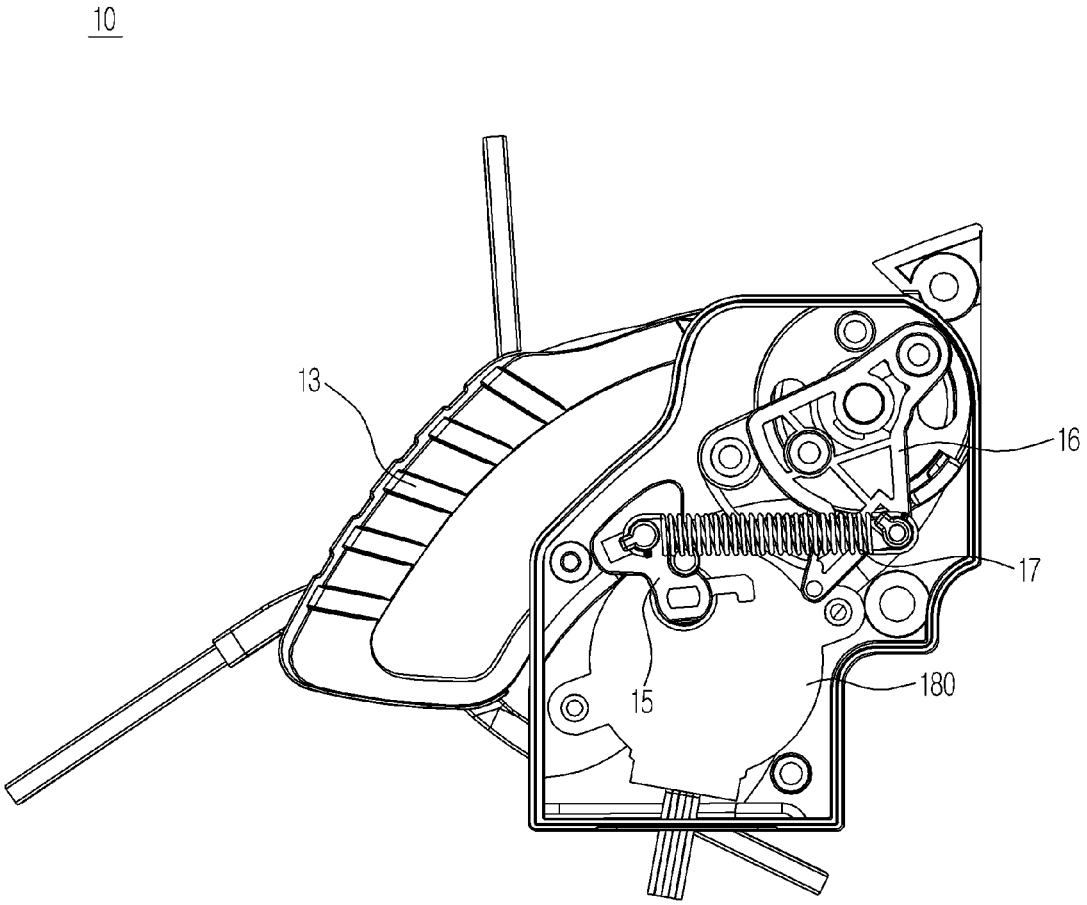
Figure 16:
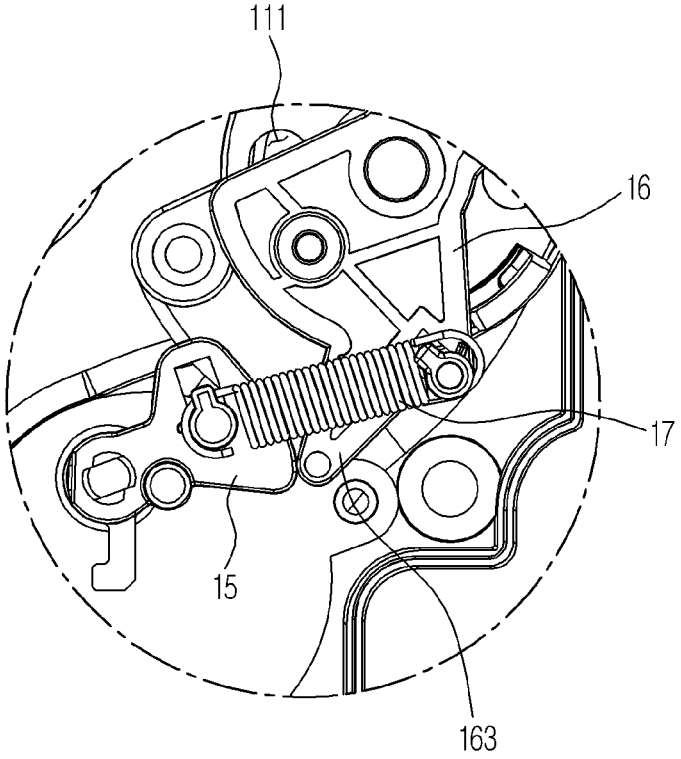
FIG. 16 is a view illustrating a locked state of the side brush assembly according an embodiment.

FIGS. 13 through 15 are views illustrating operation of the side brush assembly according to an embodiment, and FIG. 16 is a view illustrating a locked state of the side brush assembly according to an embodiment.

FIG. 13 is a view illustrating the side brush assembly 10 in the initial state, in which the driving motor 180 is inactivated and the side arm 13 is free from external force. In this embodiment, a state in which the guide pin 162 is located at the other end of the slit is defined as the initial state.

If the driving motor 180 is driven and the cam 15 rotates counterclockwise (in a direction F), the distance between the portion of the lever 16 and the portion of the cam 15, to which both ends of the elastic member 17 are respectively coupled, increases, and thus the elastic member 17 is stretched. Due to elastic restoring force of the elastic member 17, as shown in FIG. 14, the opposite portion of the lever 16 to the elastic member 17 rotates clockwise (in a direction B) about the shaft 19. The guide pin 162 provided at the lever 16 moves along the slit 111 of the side brush body 11. As the lever 16 rotates clockwise, the side arm 13 coupled to the lever 16 also rotates clockwise (in the direction B) and is exposed outside the main body 2. When the guide pin 162 arrives at one end of the slit 111, rotation of the side arm 13 stops. At this time, the distance between the portion of the lever 16 and the portion of the cam 15, to which both ends of the elastic member 17 are respectively coupled, decreases to the distance of the initial state, and the elastic member 17 is restored to the initial state.

Accordingly, the side arm 13 may be exposed outside the main body 2 by the driving motor 180. In such a state, the side brush unit 14 rotates and sweeps dust around the main body 2 or dust gathering in the corners of the floor toward the suction port 62.

As shown in FIG. 14, if external force due to contact with obstacles is applied to the side arm 13 in a direction G while the side arm 13 is in an exposed state by the driving motor 180, the side arm 13 rotates counterclockwise (in a direction D) and returns inside the main body 2. As the side arm 13 rotates counterclockwise (in the direction D), the lever 16 also rotates counterclockwise (in the direction D) about the shaft 19. When the side arm 13 completely returns inside the main body 2, the guide pin 162 may be positioned at the other end of the slit 111. At this time, the distance between the portion of the lever 16 and the portion of the cam 15, to which both ends of the elastic member 17 are respectively coupled, increases, and thus the elastic member 17 is stretched. If external force in the direction G due to obstacles is removed, the lever 16 rotates clockwise (in the direction B) by elastic restoring force of the elastic member 17. As the lever 16 rotates clockwise (in the direction B), the side arm 13 also rotates clockwise (in the direction B), and is restored to the original state and exposed outside the main body 2 again.

As shown in FIGS. 13 and 16, although external force is applied to the side arm 13 in the direction F in the initial state in which the side arm 13 is held inside the main body 2, the lever 16 is locked and does not rotate. Accordingly, the side arm 13 is prevented from being exposed outside the main body 2 by external force in the direction F.

In detail, in the initial state, the locking part 163 protruding from the lever 16 interferes with a portion of the cam 15. As long as the driving motor 180 is inactivated and the cam 15 does not rotate, the cam 15 maintains interference with the locking part 163. The cam 15 maintains contact with an inner surface of the locking part 163, in order to prevent the lever 16 from rotating clockwise (in the direction B) by movement of the guide pin 162 to one end of the slit 111 from the other end of the slit 111. Accordingly, in the initial state, the side arm 13 may not be exposed outside the main body 2 in spite of external force in the direction F.

As described above, the side brush assembly according to one or more embodiments and the robot cleaner having the same may be capable of exposing the side arm equipped with the side brush unit outside and therefore increasing a cleaning area. In addition, the side arm may be protected from damage by obstacles. In addition, in the initial state in which the side arm is held inside the main body, the side arm may be prevented from being unexpectedly exposed outside the main body although external force is applied to the side arm. Further, since the side brush assembly is modularized, if the side brush unit or the side arm needs repair or replacement due to breakdown, only the side brush assembly may be removed from the main body for repair or replacement without disassembling the main body.

Figure 17:
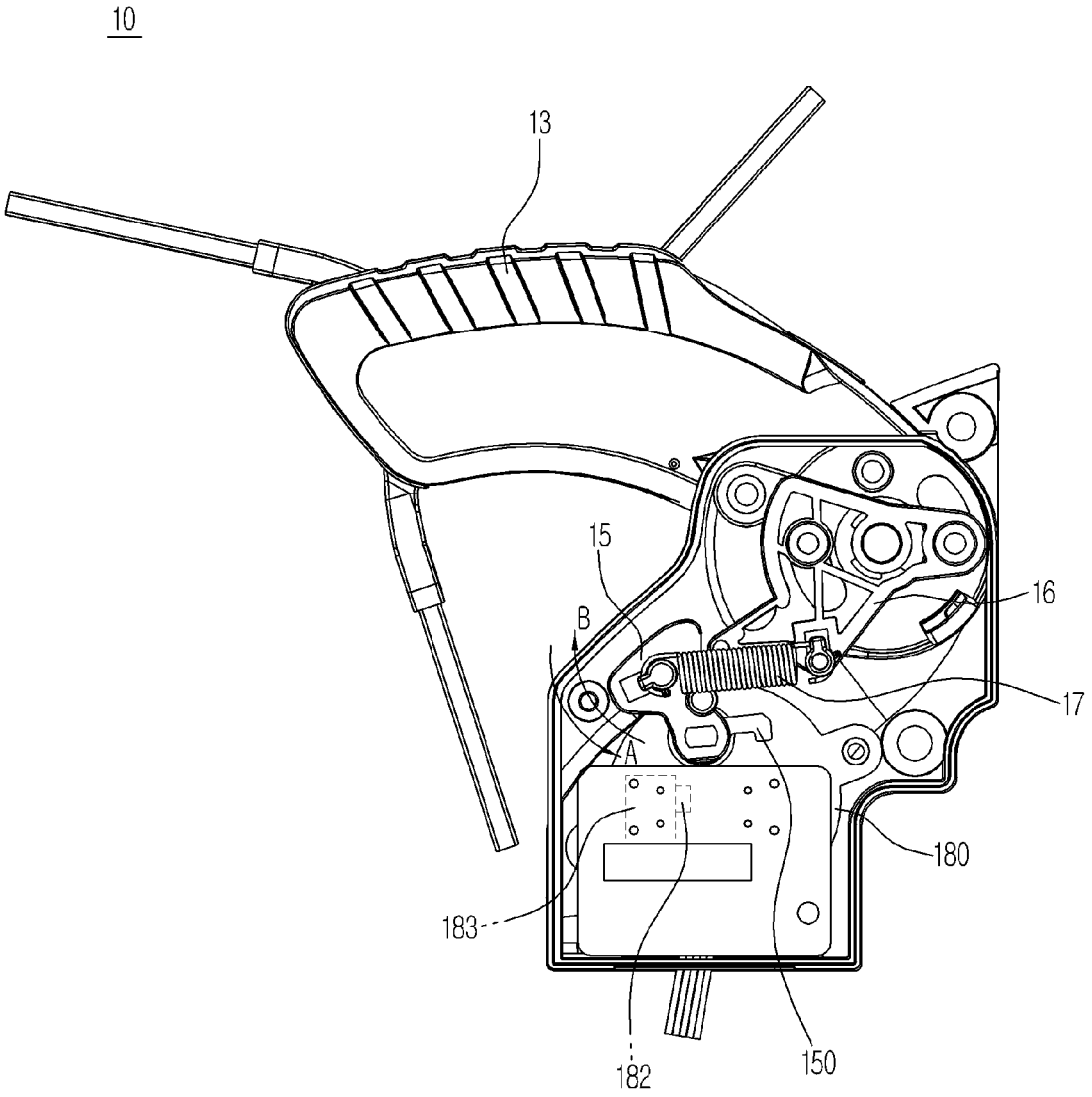
FIG. 17 is a view illustrating the side brush assembly with a side arm exposed outside a main body according to an embodiment.
Figure 18:
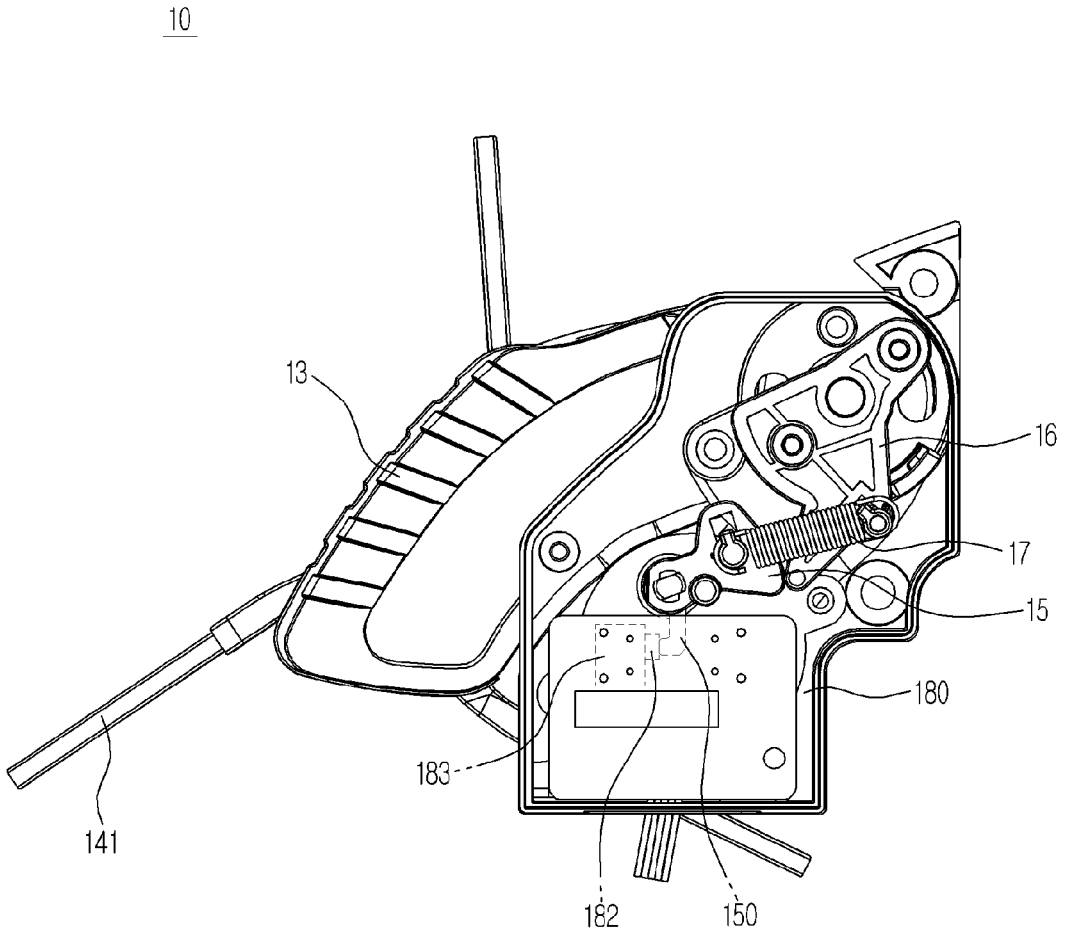
FIG. 18 is a view illustrating the side brush assembly with the side arm held inside the main body according to an embodiment.

FIG. 17 is a view illustrating the side brush assembly with the side arm exposed outside the main body, and FIG. 18 is a view illustrating the side brush assembly with the side arm held inside the main body.

Referring to FIGS. 17 and 18, the side brush assembly 10 may be provided with a pressing part 150 which may rotate together with the cam 15. If the cam 15 rotates by the driving motor 180, the pressing part 150 may rotate integrally with the cam 15. For example, the pressing part 150 may be fixed to the cam 15 or may be formed integrally with the cam 15 by injection molding. Accordingly, when the cam 15 rotates by the driving motor 180, the cam 15 and the pressing part 150 may rotate together. If the cam 15 rotates in the direction A by the driving motor 180, the side arm 13 may return inside the main body 2. At this time, the pressing part 150 also rotates with the cam 15 in the direction A.

The side brush assembly 10 may further include a sensor 183 equipped with a switch 182 which is configured to be pressed by the pressing part 150. If the cam 15 and the pressing part 150 rotate together and the side arm 13 completely returns inside the main body 2, the pressing part 150 may press the switch 182. That is, in the initial state in which the driving motor 180 is inactivated and the side arm 13 is free from external force, the pressing part 150 keeps pressing the switch 182.

If the pressing part 150 presses the switch 182, electric current flows through the sensor 183. If electric current flows through the sensor 183, the sensor 183 may detect that the side arm 13 completely returns inside the main body 2. That is, if the pressing part 150 presses the switch 182, the sensor 183 may detect that the side arm 13 completely returns inside the main body 2. The sensor 183 transmits the detected information that the side arm 13 completely returns inside the main body 2 to a control unit (not shown).

When the side arm 13 rotates by the driving motor 180 and is exposed outside the main body 2, the pressing part 150 is separated from the switch 182. If the cam 15 rotates in the direction A by the driving motor 180 and the side arm 13 completely returns inside the main body 2, the pressing part 150 presses the switch 182. If the switch 182 is pressed, electric current flows through the sensor 183, and the sensor 183 transmits the detected information that the side arm 13 completely returns inside the main body 2 to the control unit (not shown).

Hereinafter, control of operation of exposing and returning the side arm 13 will be explained.

Figure 19:
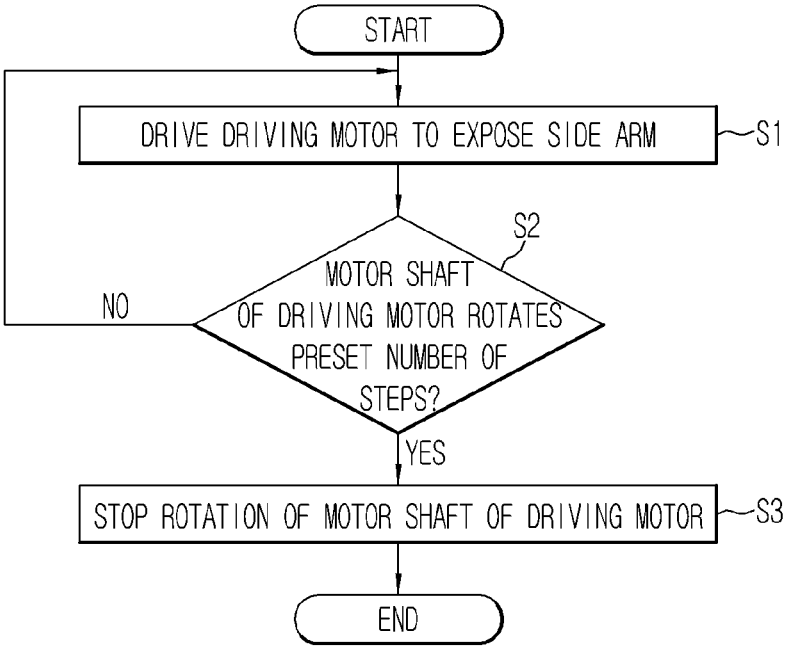
FIG. 19 is a flowchart illustrating control of operation of exposing the side arm according to an embodiment.

FIG. 19 is a flowchart illustrating control of operation of exposing the side arm according to an embodiment.

Referring to FIG. 19, in order to rotate the side arm 13 and expose the same outside the main body 2, the control unit (not shown) drives the driving motor 180 at operation S1. The control unit drives the driving motor 180 to rotate the cam 15 in the direction A. By the cam 15 rotating in the direction A, the side arm 13 rotates to be exposed outside the main body 2.

If the side arm 13 rotates to be exposed outside the main body 2, the control unit determines whether the driving motor 180 is driven the preset number of steps at operation S2. Accordingly, the control unit may determine whether the side arm 13 rotates by a preset target angle.

The target angle may be an angle between a line connecting the shaft 19 and an end of the side arm 13 which is distal from the shaft 19 in the initial state of the side arm 13 and a line connecting the shaft 19 and an end of the side arm 13 which is distal from the shaft 19 when the side arm 13 rotates to be completely exposed outside the main body 2. Depending on the shape of the main body 2, the shape of the side brush assembly 10 or the shape of the side arm 13, the target angle at which the side arm 13 is fully exposed may be preset.

The driving motor 180 may be configured as a step motor, a motor shaft of which uniformly rotates by a unit angle per step. The rotational unit angle per step may be changed depending on the number of pulses transmitted to the driving motor 180. In the case of a step motor capable of rotating once every 200 pulses, a shaft of the driving motor 180 rotates by a unit angle of 1.8 degrees per step (360 degrees/200 pulses). Therefore, the rotation angle of the driving motor 180 may be controlled by the number of pulses transmitted to the same.

In order to rotate the side arm 13 by the target angle, the preset number of steps for rotation of a shaft of the driving motor 180 may be stored in the control unit. For example, the preset target angle of 100 degrees by which the side arm 13 rotates to be fully exposed and the preset number of steps for a 100-degree rotation of the side arm 13 may be stored in the control unit. In order to expose the side arm 13, the control unit rotates the motor shaft of the driving motor 180 by the number of steps stored therein. If the driving motor 180 rotates the stored number of steps, the side arm 13 rotates by the target angle and is exposed outside the main body 2. The cam 15 may rotate corresponding to rotation of the motor shaft.

When rotation of the driving motor 180 for each step is completed, it is determined whether the motor shaft of the driving motor 180 rotates the preset number of steps. That is, whenever the driving motor 180 rotates by each unit angle, the control unit determines whether the driving motor 180 is driven the preset number of steps.

If the motor shaft of the driving motor 180 rotates the preset number of steps and the side arm 13 rotates by the preset target angle, the control unit stops rotation of the side arm 13 at operation S3. That is, if the driving motor 180 rotates the preset number of steps so as to rotate the side arm 13 by the target angle, the control unit stops rotation of the side arm 13 by stopping rotation of the driving motor 180. As a result, the side arm 13 is exposed outside the main body 2.

Figure 20:
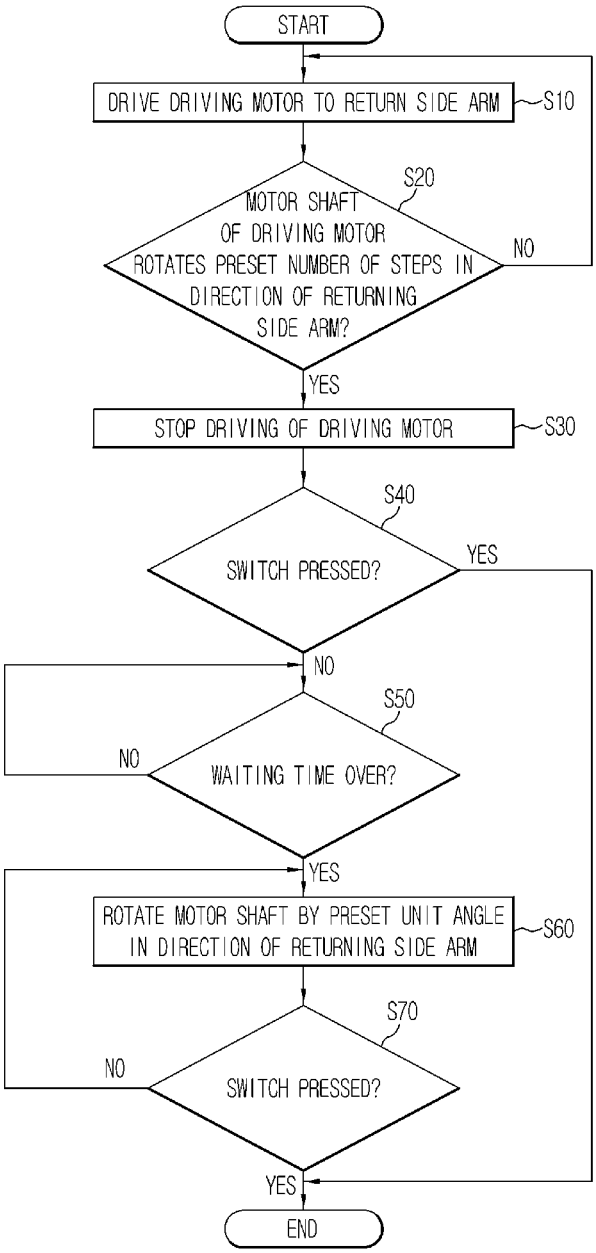
FIG. 20 is a flowchart illustrating control of operation of returning the side arm according to an embodiment.

FIG. 20 is a flowchart illustrating control of operation of returning the side arm according to an embodiment.

Referring to FIG. 20, in order to rotate the side arm 13 and return the same inside the main body 2, the control unit (not shown) rotates the motor shaft of the driving motor 180 at operation S10. The control unit drives the driving motor 180 to rotate the cam 15 in the direction B. By the cam 15 rotating in the direction B, the side arm 13 rotates to return inside the main body 2.

The control unit determines whether the motor shaft of the driving motor 180 rotates the preset number of steps at operation S20. Since the motor shaft of the driving motor 180 has rotated the preset number of steps when the side arm 13 is exposed outside the main body 2, the motor shaft rotates the identical number of steps also when the side arm 13 returns inside the main body 2. When the side arm 13 returns inside the main body 2, the motor shaft rotates in an opposite direction to the rotating direction when the side arm 13 is exposed outside the main body 2. Whenever the motor shaft rotates by each unit angle, the control unit determines whether the motor shaft of the driving motor 180 rotates the preset number of steps.

If it is determined that the motor shaft of the driving motor 180 has not rotated the preset number of steps, the control unit keeps driving the driving motor 180. That is, if it is determined that the motor shaft of the driving motor 180 has not rotated the preset number of steps, the control unit further rotates the driving motor 180 by another unit angle, and determines again whether the motor shaft of the driving motor 180 rotates the preset number of steps. If it is determined that the motor shaft of the driving motor 180 has rotated the preset number of steps, the control unit stops activation of the driving motor 180 to stop rotation of the motor shaft at operation S30.

If rotation of the motor shaft stops, the control unit determines whether the switch 182 is pressed at operation S40. If the switch 182 is pressed, the sensor 183 detects that the side arm 13 completely returns inside the main body 2. The sensor 183 transmits the detected information that the side arm 13 completely returns inside the main body 2 to the control unit. If the control unit receives the information that the switch 182 is pressed, the control unit stops rotation of the motor shaft and terminates the operation of returning the side arm 13.

If it is determined that the switch 182 is not pressed, it may be determined that the side arm 13 does not completely return inside the main body 2. That is, it may be determined that the side arm 13 does not completely return inside the main body 2 due to interference with external obstacles.

The control unit determines whether a waiting time is over in the inactivated state of the driving motor 180 at operation S50. Here, the waiting time is defined as a time necessary to remove external obstacles interfering with the side arm 13. The waiting time may be preset and stored in the control unit. For example, the waiting time may be preset to 30 seconds. If it is determined that the switch 182 is not pressed, the control unit determines whether the waiting time of 30 seconds is over. A user may remove obstacles interfering with the side arm 13 within the waiting time. A robot cleaner 1 may also remove obstacles blocking return of the side arm 13 within the waiting time by specific operation. For example, when the side arm 13 cannot completely return inside the main body 2, the robot cleaner 1 may perform rotational movement or linear movement during the waiting time, to thereby remove obstacles blocking return of the side arm 13.

In the inactivated state of the driving motor 180, if the waiting time is over, the control unit drives the driving motor 180 and rotates the motor shaft by the preset unit angle in the direction of returning the side arm 13 at operation S60. If the motor shaft rotates by the unit angle, the control unit determines whether the switch 182 is pressed at operation S70. If it is determined that the switch 182 is not pressed, the control unit drives the driving motor 180 and further rotates the motor shaft by another unit angle. If it is determined that the switch 182 is pressed, the sensor 183 transmits the information that the side arm 13 completely returns inside the main body 2 and the switch 182 is pressed to the control unit, and the control unit terminates the operation of returning the side arm 13.

After the waiting time is over, if the switch 182 is not pressed although the driving motor 180 has rotated the preset number of steps, additional waiting time may be provided. If a user removes obstacles or the robot cleaner 1 removes obstacles by specific operation within the waiting time, the control unit may drive the driving motor 180 until the switch 182 is pressed.

As is apparent from the above description, the side arm 13 equipped with the side brush unit 14 is exposed outside the main body 2, and cleans corners and spaces between obstacles. The side brush unit is prevented from being damaged due to interference with external obstacles and being forcibly and unexpectedly exposed by external obstacles in the state of being held inside the main body 2. Also, the side arm 13 may return inside the main body 2, and it may be detected whether the side arm 13 completely returns depending on whether the switch 182 is pressed or not. When the side arm 13 cannot completely return inside the main body 2 due to interference with obstacles, a user may remove the obstacles or the robot cleaner 1 may remove the obstacles blocking return of the side arm 13 by rotational or linear movement within the waiting time. As a result, the side arm 13 may completely return inside the main body 2 with reliability.

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. A robot cleaner comprising:

a main body to remove dust from a floor while traveling on the floor; and at least one side brush assembly provided at the main body in order to increase a dust-removing area on the floor, wherein the at least one side brush assembly includes:

a side brush body;

a side arm mounted to a bottom surface of the side brush body and configured to be exposed outside the main body;

a side brush unit rotatably mounted to the side arm;

a lever connected to the side arm and configured to rotate together with the side arm;

a cam configured to rotate by receiving driving force from a driving motor; and an elastic member to connect the lever and the cam in order to rotate the lever by elastic force thereof.

2. The robot cleaner according to claim 1, wherein the side brush body is formed with a through-hole, through which a shaft is inserted, and wherein the shaft inserted through the through-hole passes through the side brush body and the lever to connect the same.

3. The robot cleaner according to claim 2, wherein the side brush body is formed with a slit near the through-hole.

4. The robot cleaner according to claim 3, wherein the lever is provided with a guide pin, and wherein the guide pin moves along the slit as the lever rotates.

5. The robot cleaner according to claim 4, wherein when the cam rotates by the driving motor, the guide pin moves along the slit in a first direction by elastic force of the elastic member, and the side arm is exposed outside the main body.

6. The robot cleaner according to claim 5, wherein:

if external force is applied in a direction of returning the side arm inside the main body in a state of being exposed outside the main body, the guide pin moves along the slit in a second direction opposite to the first direction, and if the external force is removed, the guide pin moves along the slit in the first direction by elastic force of the elastic member, and the side arm is restored to the state of being exposed outside the main body.

7. The robot cleaner according to claim 4, wherein:

if external force is applied in a direction of exposing the side arm outside the main body in a state of being held inside the main body, the guide pin moves along the slit in a first direction, and if the external force is removed, the guide pin moves along the slit in a second direction opposite to the first direction by elastic force of the elastic member, and the side arm is restored to the state of being held inside the main body.

8. The robot cleaner according to claim 4, wherein the lever is provided with a locking part which is configured as a protrusion extending outward from the lever.

9. The robot cleaner according to claim 8, wherein:

the locking part is configured to interfere with the cam in a state that the side arm is held inside the main body, and although external force is applied in a direction of exposing the side arm outside the main body, the lever is prevented from rotating by interference of the locking part with the cam.

10. The robot cleaner according to claim 4, wherein the guide pin is integrally formed with the lever.

11. The robot cleaner according to claim 1, wherein the side brush assembly is removably mounted to a bottom surface of the main body.

12. The robot cleaner according to claim 11, wherein:

the side brush body is formed with a coupling hole, and wherein the side brush body is coupled to the main body by a coupling member which is inserted through the coupling hole and the bottom surface of the main body.

13. The robot cleaner according to claim 1, wherein the side arm is provided with a driving shaft which is mounted to the side brush unit, and a side brush driving motor to supply driving force to the driving shaft to rotate the same.

14. A side brush assembly comprising:

a side brush body formed with an accommodating part;

a driving motor accommodated in the accommodating part;

a cam configured to rotate by receiving driving force from the driving motor;

a lever rotatably provided at the side brush body;

an elastic member connecting the cam and the lever and configured to rotate the lever by being stretched by rotation of the cam or external force;

a side arm configured to integrally rotate with the lever; and a side brush unit rotatably mounted to the side arm.

15. The side brush assembly according to claim 14, wherein the side arm and the lever are respectively fixed to both ends of a shaft which is inserted through the side brush body.

16. The side brush assembly according to claim 14, wherein:

if external force is applied, the side arm rotates in a first direction, and if the external force is removed, the side arm rotates in a second direction opposite to the first direction and returns to an original position.

17. The side brush assembly according to claim 14, wherein the lever is provided with a locking part which is configured as a protrusion extending from the lever.

18. The side brush assembly according to claim 17, wherein if the driving motor is inactivated and the cam does not rotate, rotation of the lever and the side arm is prevented due to interference of the locking part with the cam.

19. The side brush assembly according to claim 14, wherein the side brush body is formed with a slit, and the lever is provided with a guide pin which is configured to be guided by the slit.

20. The side brush assembly according to claim 19, wherein the side arm is limited in rotation in at least one direction by a length of the slit.

* * * * *